US008167060B2

(12) United States Patent
Brunet et al.

(10) Patent No.: US 8,167,060 B2
(45) Date of Patent: May 1, 2012

(54) APPARATUS AND METHOD FOR CONVEYANCE AND CONTROL OF A HIGH PRESSURE HOSE IN JET DRILLING OPERATIONS

(76) Inventors: Charles Brunet, Houston, TX (US); Michel Bouchard, Calgary (CA)

( * ) Notice: Subject to any disclaimer, the term of this patent is extended or adjusted under 35 U.S.C. 154(b) by 809 days.

(21) Appl. No.: 12/203,504

(22) Filed: Sep. 3, 2008

(65) Prior Publication Data

US 2009/0101414 A1 Apr. 23, 2009

Related U.S. Application Data

(60) Provisional application No. 60/999,705, filed on Oct. 22, 2007.

(51) Int. Cl.
*E21B 7/18* (2006.01)

(52) U.S. Cl. ..... 175/424; 175/62; 175/79; 166/222

(58) Field of Classification Search ..... 166/50, 166/308.1, 222, 223; 175/61, 62, 73, 79, 175/424

See application file for complete search history.

(56) References Cited

U.S. PATENT DOCUMENTS

| | | | | |
|---|---|---|---|---|
| 4,928,757 | A * | 5/1990 | Schellstede et al. | 166/55.1 |
| 5,435,400 | A | 7/1995 | Smith | |
| 6,257,353 | B1 * | 7/2001 | Belew et al. | 175/2 |
| 6,263,984 | B1 * | 7/2001 | Buckman, Sr. | 175/67 |
| 6,315,054 | B1 | 11/2001 | Brunet | |
| 6,374,918 | B2 | 4/2002 | Roberts et al. | |
| 7,168,491 | B2 * | 1/2007 | Malone et al. | 166/298 |
| 2003/0127251 | A1 * | 7/2003 | Mazorow | 175/62 |
| 2006/0278393 | A1 * | 12/2006 | Hunt et al. | 166/298 |
| 2008/0179061 | A1 * | 7/2008 | McAfee | 166/298 |
| 2009/0288833 | A1 * | 11/2009 | Graham et al. | 166/306 |
| 2009/0288884 | A1 * | 11/2009 | Jelsma | 175/67 |

* cited by examiner

*Primary Examiner* — Daniel P Stephenson
(74) *Attorney, Agent, or Firm* — McGarry Bair PC

(57) ABSTRACT

A jetting hose is conveyed downhole retracted within a tubing string for jetting lateral boreholes from a main wellbore, is released at the jetting depth and pumped from the tubing string and into a lateral borehole with jetting fluid. A piston is secured to the upper end of the jetting hose, and the pumped jetting fluid drives the piston. A speed control regulates the penetration rate of the jetting hose into the formation independent of the tubing string weight.

33 Claims, 13 Drawing Sheets

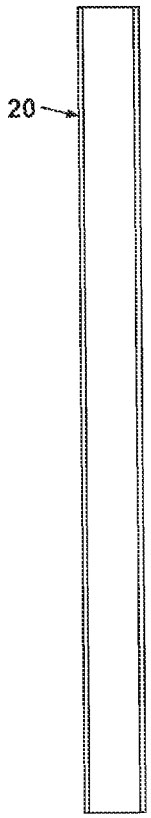
Fig. 12A
Fig. 12B
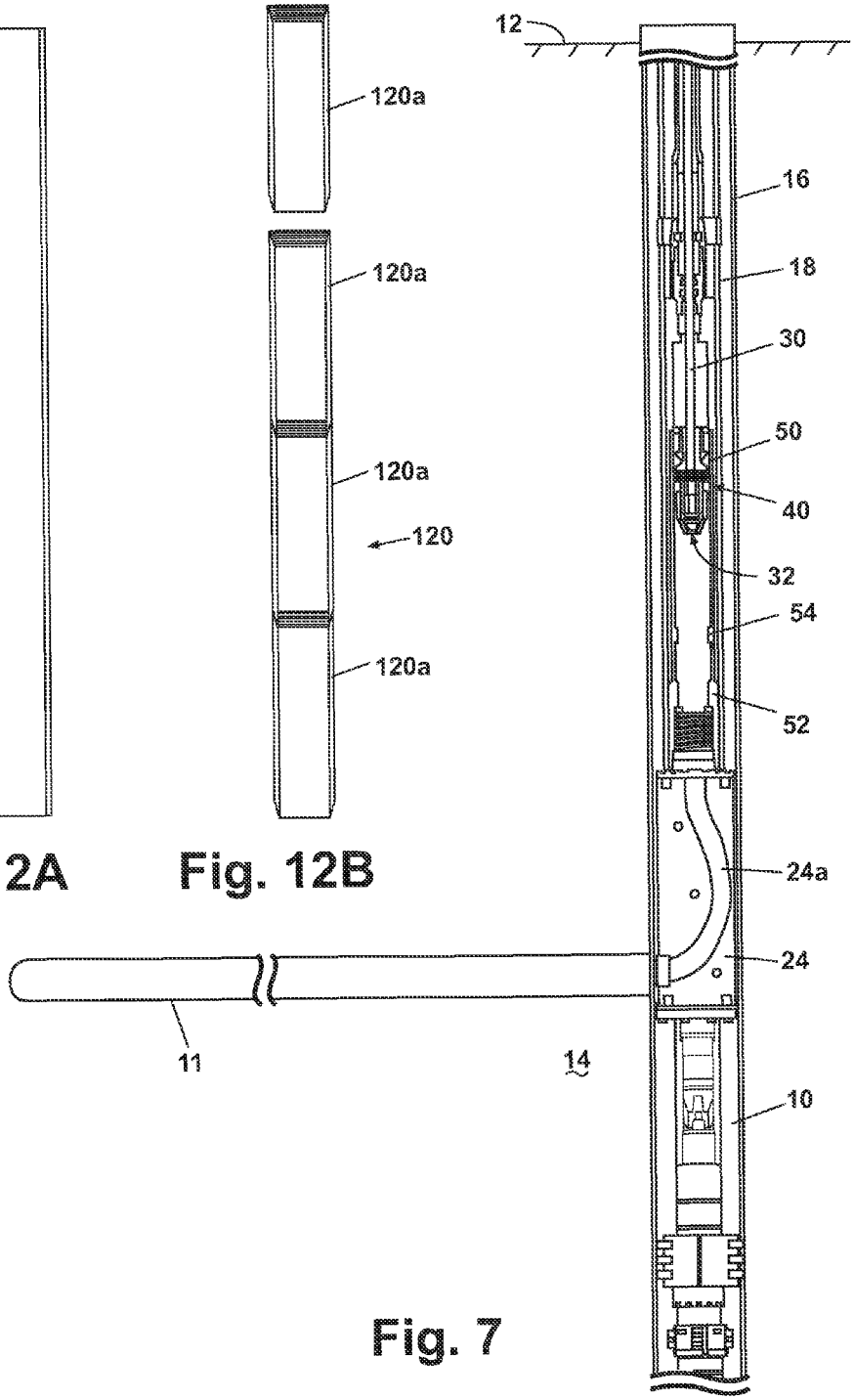
Fig. 7

APPARATUS AND METHOD FOR CONVEYANCE AND CONTROL OF A HIGH PRESSURE HOSE IN JET DRILLING OPERATIONS

CROSS-REFERENCE TO RELATED APPLICATIONS

This application is related to and claims priority of U.S. Provisional Application No. 60/999,705 by the same inventors (Brunet and Bouchard) filed Oct. 22, 2007, the disclosure of which is incorporated herein by reference in its entirety.

BACKGROUND OF THE INVENTION

1. Field of the Invention

The invention relates to apparatus and methods for drilling lateral boreholes from a main wellbore using a high pressure jetting hose for hydrocarbon recovery. In one of its aspects, the invention relates to a method and system for controlling the rate at which a lateral bore hole is drilled by jetting a fluid at high pressure into the formation. In another of its aspects, the invention relates to a method and system for conveying a high pressure jetting hose into a main well bore for later drilling into a producing formation.

2. Description of Related Art

The creation of lateral (also known as "radial") boreholes in oil and gas wells using high pressure radial jetting was first introduced in the 1980's. Various tools have been used to create a lateral borehole for the purpose of extending the "reach" of the wellbore. The most currently accepted approach involves milling holes in the wellbore casing, and then subsequently using a tubing string to lower a high pressure jetting hose with a nozzle on the leading end into the reservoir. The configuration of the nozzle is such that it contains more opening area in the rearward facing direction than the forward direction. This configuration results in a forward thrust on the nozzle, causing the nozzle to pull the hose behind it as the lateral borehole is created. The upper end of the more-flexible jetting hose is affixed to the lower end of the less-flexible tubing string, and it is therefore desirable to continue feeding the tubing string into the wellbore at the same speed at which the jetting nozzle is creating a lateral borehole. If the tubing string feed rate is too fast, the jetting nozzle path becomes erratic and the lateral borehole is not straight, too slow and the jetting nozzle creates a cavity behind itself resulting in the loss of forward thrust.

Historically, small diameter coiled tubing of ½" (inch) or less is used to convey the jetting hose, which is typically ¼" (inch) high-pressure hydraulic hose attached to the end of the small diameter coiled tubing. This small diameter tubing possesses sufficient sensitivity and flexibility to allow the operator some control over the feed-in rate from the surface. The operator uses surface gauges to compare the hanging weight of the relatively lightweight (for example, 4 ft/lb) small diameter tubing to the pressure drop at the jetting nozzle, and typical sensitivity of 25-lbs is generally available.

The prior approach using small diameter flexible coiled tubing is limited, however, in terms of depth, downhole inclination angles, utilization in flowing wells, and other areas. The limited strength of the tubing limits the depths at which it can be used. The angle of the wellbore across which the small diameter jetting hose can be used is limited by the hose's attachment to the end of the small diameter coiled tubing which, although more flexible than standard size coiled tubing, is limited to wellbore angles of around 30 degrees or less. Specialized tube feeding units are required on the surface for the lateral jetting operation, since standard size coiled tube feeding units cannot be used with the small diameter tubing.

Other problems are created by the limitations of the small diameter flexible jetting hose itself that preclude it from being used without tubing to convey it downhole. Small diameter flexible hose is limited in strength and cannot withstand significant tensile forces acting upon it, and is also limited in the length of flexible hose that can be lowered into a deviated main wellbore. Small diameter flexible hose cannot be sealed around the outside of the hose at a grease injector to allow it to be used in conjunction with pressure seal equipment on the surface, thus precluding its use in flowing wells. Small diameter flexible hose cannot be used in conjunction with an injector head on the surface that creates force to push the hose into, or, alternately, pull the hose out of, an oil or gas well, since the hose is so flexible that it cannot be easily pushed downward. Small diameter flexible jetting hose is limited in the deviation angle across which it can be lowered at the bottom of the wellbore.

Still another problem with prior apparatus and methods used to form lateral boreholes with a jetting hose lowered with small diameter coiled tubing is that success is greatly dependent on the skill of the operator in charge of the installation.

Standard size coiled tubing, generally constructed from carbon or stainless steel and deformably wrapped on a powerful reel on the surface, is typically on the order of 1¼" to 1½" (inches) in diameter or larger, and weighs significantly more (for example, 2 lbs/ft) than the small diameter coiled tubing used in the prior art. Using standard sized coiled tubing would allow the jetting hose to be employed at greater depths, higher inclination angles, and in flowing well applications, but would make it significantly more difficult to control the tubing feed rate relative to jetting nozzle progress during lateral borehole formation using standard weight versus pressure comparisons. For example, the weight gauges for standard coiled tubing are typically in 100-lb to 200-lb increments, and so are simply not sensitive enough to use the hanging weight of the tubing as a benchmark for comparison to the feed-in rate and pressure drop. Accordingly, even a skilled operator would find it impractical to use the usual weight measurements to control the feed-in rate of the jetting hose using standard coiled tubing.

Standard coiled tubing is also limited in the bending radius that it can traverse, which does not allow its use for some jetting operations.

Thus the use of standard coiled tubing and other larger-diameter, stronger, deep-application hose-conveying equivalents (such as jointed pipe with threaded connections on either end) is discouraged. Conventional jointed pipe also requires a significant amount of time to connect the joints together, which is particularly worrisome when inserting and removing the pipe sections from a well drilled for producing hydrocarbons, since it results in great operating expense due to costs related to labor, rig rental, and other factors known to those skilled in the art.

SUMMARY OF THE INVENTION

According to the invention, a high pressure flexible jetting hose with a jetting nozzle (or jetting "head") for forming lateral boreholes is operated with a sliding connection inside a larger diameter feed-tube or jointed pipe (hereafter "standard coiled tubing" or "coiled tubing" or "tubing string"), preferably standard size coiled tubing. In a particular and preferred form, the jetting hose is mounted on a traveling piston sized to slide within the tubing string. The piston can be sealed relative to the tubing string to prevent any fluid bypass around the piston, or can be sized to allow a known amount of bypass. By "slide" and "sliding" we mean any form of up or down movement of the jetting hose inside of, and relative to, the tubing string.

In one embodiment, the leading end of the standard tubing string is provided with a hose lock and seal device (HLSD) that holds the jetting hose in a retracted position inside the tubing string as the tubing string transports the hose to a point at or near the bottom of the workstring in the wellbore. A complementary landing profile is provided at the bottom of the workstring for the HLSD to land and create a seal between the tubing string and the workstring. The jetting hose is then released by the HLSD and extended out under fluid pressure to jet lateral boreholes. In the preferred form, the landing profile is a receiver sub located at a deflector device such as a deflector shoe.

In a first embodiment, the tubing string is stopped abruptly above the deflector shoe, or is lowered until the HLSD briefly contacts or "tags" the deflector shoe and is then reeled back up, triggering the HLSD to release and extend the jetting hose from the tubing string prior to jetting a lateral borehole. The hose is extended by pumping pressurized fluid down the tubing string against the piston until the piston lands and locks in a landing profile at the end of the tubing string ("pump and lock"). The tubing string is then lowered, with the jetting hose fully extended from the end of the tubing, to initiate the jetting operation.

In a second, preferred embodiment, the tubing string is landed and held at the bottom of the workstring to trigger the HLSD and release the jetting hose, which begins jetting a lateral borehole as it is being extended from the tubing string ("pump and jet"). The tubing string is held in place as the high pressure fluid propels the jetting hose forward through the deflector shoe and jets a lateral wellbore in the surrounding formation, until the piston lands in the landing profile at the end of the tubing string. In this embodiment, the need for close control over the feed-in rate of the tubing string is eliminated from the lateral jetting operation, since the fluid pressure that extends the jetting hose also controls the speed of lateral borehole formation.

When the lateral borehole has been jetted, the jetting hose can be retracted from the lateral borehole (and optionally back up into the tubing string) in different ways prior to jetting another lateral. In one embodiment, high-pressure fluid is pumped into the annulus between the landed tubing string and the workstring (production) tubing to drive the piston upward and cause the extended jetting hose to retract into the tubing string. In a second embodiment, the tubing string is raised with the jetting hose fully extended. In an intermediate embodiment, the tubing string is raised with the jetting hose fully extended until the jetting hose has been drawn back up into the main wellbore, and then fluid is pumped down the annulus between the tubing string and the workstring or production tubing to retract the jetting hose into the tubing string. As the jetting hose is retracted from the newly formed borehole using any of the above methods, the jetting head can continue to enlarge the lateral borehole.

In a further embodiment of the invention, a speed control device is associated with the sliding jetting hose so that fluid pressure across the piston is balanced or self-regulated, allowing the nozzle thrust to control the penetration speed of the jetting hose during lateral borehole formation.

In one embodiment, the speed control device is a fluid-relief orifice between the piston and the HLSD that allows fluid located between the outside of the jetting hose and the inside of the tubing string on the downhole side of the piston to be evacuated out through the production (workstring) tubing as the jetting hose is extended. Increasing or decreasing the size of the orifice controls the speed at which the jetting hose advances. The speed control device is useful primarily when jetting a lateral borehole as the hose is extended from the landed tubing string ("pump and jet").

In a further embodiment, speed control is enhanced by pumping a counterbalancing annular fluid pressure down the production tubing to act against the bottom of the piston while jetting fluid is pumped down through the tubing string against the top of the piston. By properly adjusting the jetting fluid and annular fluid pumps at the surface, the jetting nozzle can be fully compensated, allowing the nozzle thrust itself to regulate the penetration rate. Also, by observing the level of the annular fluid in a reservoir at the surface, the operator can estimate the length of the lateral borehole.

Therefore, according to the invention, an apparatus for jetting lateral boreholes from a main wellbore using a high pressure jetting hose conveyed down a workstring in the wellbore by a tubing string comprises a releasable hose locking device mounted on an end portion of the tubing string to selectively retain the high pressure flexible jetting hose within the tubing string in a hose-conveying position retracted inside the tubing string and to release the jetting hose for movement to a jetting position that is extended from the lower end portion of the tubing string to jet a lateral borehole from the wellbore.

In one embodiment, a fluid-operated piston is mounted to the jetting hose and is sized to slide within the tubing string. Typically, the piston is mounted on an upper end of the jetting hose so that the jetting hose depends from the piston. Further, the piston can include a passage between the tubing and the jetting hose to pass jetting fluid therethrough, whereby jetting fluid pumped down the tubing string applies hose-extending fluid pressure to the piston and also passes through the piston into the jetting hose for jetting a lateral borehole through a jetting head.

In one embodiment, a speed control on the tubing string is adapted to control the balance between the thrust and penetration rates of the lower end of the jetting hose. In addition, the speed control can compensate from frictional forces between the jetting hose and the lateral well bore and between the jetting hose and a deflecting shoe which bends the jetting hose from a vertical axis into a lateral direction, for example, up to 90°, as the jetting hose penetrates the formation. These frictional forces will typically increase with the distance that the jetting hose penetrates the formation. Typically, the speed control can include a fluid-relief orifice in the workstring between the piston and the jetting head to release into the annulus between the tubing string and the workstring fluid driven from a first annulus between the tubing string and the jetting hose by the downward movement of the piston.

In another embodiment, the orifice is located at surface on the workstring between the tubing string/workstring annulus and a fluid reservoir. This annulus communicates with the jetting hose/tubing annulus via an orifice at the bottom of the tubing string which would be bigger in size than the surface one (so as not to be the flow controlling one). Having the controlling orifice at surface makes it easier to adjust its size (essentially a valve), hence controlling the pressure under the piston which in turn controls the penetration rate of the jetting hose. In this embodiment, the tubing string/work string annulus is filled to the surface with fluid.

This embodiment, when combined with another pump connected in the fluid reservoir, makes the jetting process a closed hydraulic system which fully controls the jetting process penetration and retraction without the need for any mechanical manipulation of the Tubing.

In another embodiment, the tubing string comprises coiled tubing of a standard size in excess of 1 inch (2.54 cm). Alternately, the tubing string can be jointed tubing.

In a preferred embodiment, the releasable hose locking device can be positioned at a leading end of the tubing string. In addition, the hose locking device can at least in part be responsive to the weight of the tubing to release the jetting hose. Further, a landing profile can be positioned adjacent a location within the wellbore, preferably in the workstring, where a lateral borehole is to be jetted and the landing profile can be configured to receive and unlock the hose-locking device to release the jetting hose. Further, the landing profile can include a receiver sub mounted above a hose-deflector device in the wellbore.

In yet another embodiment, the hose-locking device can include opposed fingers that are movably mounted between a locking and release position with respect to the lower end portion of the jetting hose, and the fingers can be biased into the locking position.

Further according to the invention, a method for jetting lateral boreholes from a main wellbore using a high pressure flexible jetting hose comprises positioning the high pressure flexible jetting hose within a tubing string in an upper portion of the main borehole; releasably locking a lower end portion of the high pressure flexible jetting hose to a lower end portion of the tubing string; conveying the tubing string down the main borehole with the high pressure flexible jetting hose inside the tubing string to a predetermined depth at or near a producing strata; unlocking the lower end of the high pressure flexible jetting hose from the lower end of the tubing string; extending the high pressure flexible jetting hose from the lower end of the tubing string and into a jetting position to bore a lateral (radial) bore hole in the producing strata; and pumping a jetting fluid under pressure into the tubing string and into the high pressure jetting hose to jet a lateral borehole from the main wellbore.

In one embodiment, the unlocking act includes the act of landing the lower end of the tubing string on a landing profile at the predetermined depth of the wellbore to release the lower end of the jetting hose from the lower end of the tubing string.

In another embodiment, the extending act includes raising the tubing string with respect to the high pressure jetting hose to extend the lower end portion of the jetting hose from the lower end portion of the tubing string.

In another embodiment, the lower end portion of the tubing string is held at the landing profile in the wellbore as the jetting hose is extended from the lower end of the tubing string to jet a lateral (radial) borehole in the producing strata.

In other embodiment, the moving act of the lower end portion of the jetting hose with respect to the tubing string subsequent to the unlocking act is responsive to the pressure of the jetting fluid pumped through the tubing string and into the jetting hose to simultaneously jet a borehole in a formation in front of the lower end portion of the jetting hose and provide a forward thrust to the lower end portion of the jetting hose to penetrate the formation. In addition, the forces on an upper end of the jetting hose can be substantially balanced during the moving act so that the jetting hose moves into the formation at a controlled rate that reflects the rate at which the jetting action bores into the producing strata. In one embodiment, the balancing act can be accomplished by pumping fluid from a second annulus between the workstring and the tubing string into a first annulus between the jetting hose and the tubing string and beneath an upper end portion of the jetting hose. In another embodiment, the balancing act can be accomplished by passing fluid through the upper end of the jetting hose into a first annulus between the first annulus between the jetting hose and the tubing string and venting the fluid pressure in the first annulus into a second annulus between the workstring and the tubing string at a controlled rate.

In a further embodiment, annular fluid can be pumped down the workstring from the second annulus between the workstring and the tubing string into a first annulus between the jetting hose and the tubing string against an underside of a piston at an upper portion of the jetting hose to retract the jetting hose back up into the tubing string after the lateral borehole has been jetted. Further, subsequent to the pumping, the high pressure flexible jetting hose can be retracted into the lower end of the tubing string from the jetting position after the lateral borehole has been jetted until the jetting hose is withdrawn at least back into the wellbore. Typically, fluid can be pumped down the workstring to an underside of the piston after the jetting hose has been withdrawn into the wellbore to retract the jetting hose back up into the tubing string.

Further according to the invention, a method of jetting lateral boreholes from a main wellbore using a high pressure jetting hose comprises conveying the jetting hose down a workstring in the wellbore with a tubing string, and independently moving the jetting hose relative to the tubing string prior to or during a lateral jetting operation in order to position the jetting hose for the lateral jetting operation.

In one embodiment, the tubing string is landed in the wellbore. Further, the act of independently moving the jetting hose can include moving the jetting hose independently of the tubing prior to landing the tubing string in the wellbore. Further, the act of independently moving the jetting hose includes extending the jetting hose relative to the tubing prior to the lateral jetting operation and then further conveying the extended jetting hose downhole with the tubing string to initiate the lateral jetting operation. In addition, the act of independently moving the jetting hose can include extending the jetting hose relative to the tubing string after landing the tubing string in the wellbore to initiate the jetting operation. Still further, the rate at which the jetting hose penetrates the formation can be controlled by balancing the thrust forces on the jetting hose during the lateral jetting operation with retraction forces so that the jetting hose can penetrate the formation at substantially the same rate that it moves with respect to the tubing string. The control of the rate at which the jetting hose penetrates the formation can further take into account the frictional forces acting on by at least one of the jetting hose the formation and by a deflection shoe.

In one embodiment, substantially balancing the forces on an upper portion of the jetting hose are substantially balanced by independently moving the jetting hose so that the jetting hose moves into the formation at a controlled rate that reflects the rate at which the jetting action bores into the formation.

The balancing act includes applying fluid pressure from a second annulus between the workstring and the tubing string into a first annulus between the jetting hose and the tubing string and to an upper portion of the jetting hose.

In another embodiment, the jetting hose can be retracted relative to the tubing string after the lateral jetting operation. Typically, the jetting hose can be retracted by pumping fluid down the tubing string/workstring annulus and up the jetting hose/tubing string annulus behind the piston. In addition, the independent movement of the jetting hose can include pumping jetting fluid through the tubing string into the jetting hose.

Still further according to the invention, a method for conveying a jetting hose down a wellbore with a tubing string for jetting lateral boreholes from the wellbore comprises conveying the jetting hose down the wellbore inside the tubing string, and extending the jetting hose from the tubing string to jet a lateral borehole. In addition, the method can include the step of retracting the jetting hose back into the tubing string after the lateral borehole is jetted. Typically, the jetting hose is retracted back into the tubing string by pumping an annular fluid pressure down the wellbore around the tubing string. Further, the jetting hose can be extended from the tubing string by pumping jetting fluid through the tubing into the jetting hose.

In one embodiment, the rate at which the jetting hose is extended from the tubing can be controlled so that the jetting hose is extended at substantially the same rate that it penetrates the formation, preferably by applying a counterbalancing fluid pressure on an upper portion of the jetting hose as the jetting hose is extended.

This act of controlling the rate includes applying a counterbalancing fluid pressure to an upper portion of the jetting hose as the jetting hose is extended.

These and other features and advantages of the invention will become apparent from the detailed description below, in light of the accompanying drawings.

BRIEF DESCRIPTION OF THE DRAWINGS

FIG. 7 shows the completed lateral borehole formed during the steps in FIGS. 5 and 6, and the fully retracted hose and HLSD being withdrawn back up the wellbore.

FIGS. 12A and 12B show side elevation views, in cutaway section, of sections of tubing string and jointed tubing, respectively.

DESCRIPTION OF THE PREFERRED EMBODIMENT

Figure 1:
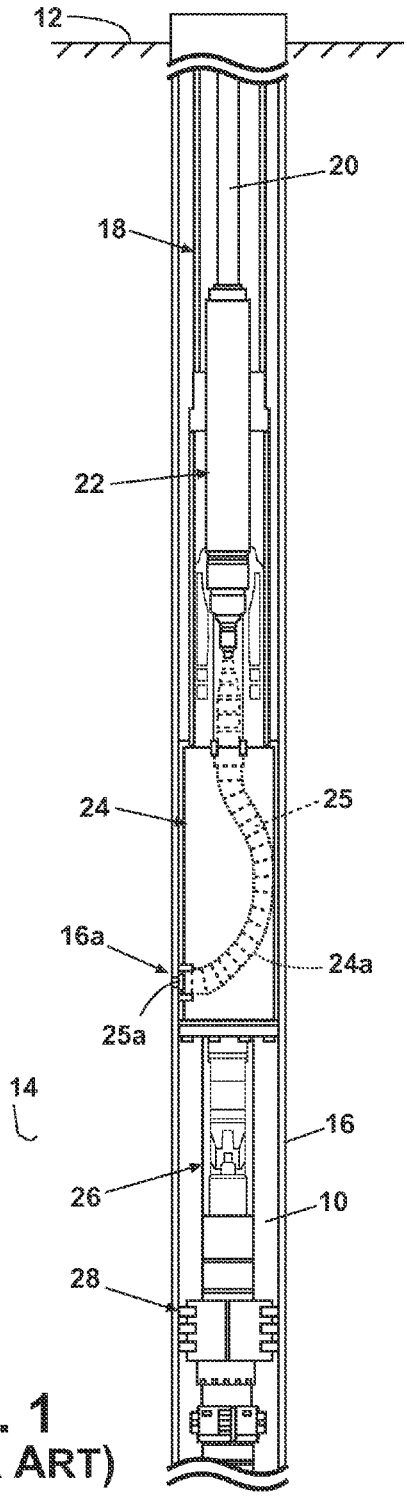
Fig. 1 (PRIOR ART)
FIG. 1 is a side view of a prior art casing milling assembly on the end of the mud motor as it is landed in the deflector shoe prior to initiating milling operations.

FIG. 1 shows a prior assembly used for cutting lateral openings in the casing 16 of a vertical wellbore 10, and for subsequently redirecting a jetting hose out through the openings to jet lateral boreholes in formation 14. In general, the assembly includes a deflector shoe 24 supported at or near the bottom of the workstring, for example secured to the end of the workstring ("production") tubing 18, and a flexible linked cutting tool 25 rotatably driven by a mud motor 22 lowered on the end of standard tubing string 20. Cutting tool 25 is selectively extended through a channel 24*a* in deflector 24 to place cutting head 25*a* in contact with the wellbore casing 16, forming lateral openings 16*a* for entry of a jetting hose into the surrounding formation 14 in known manner. The vertical and rotational positioning of deflector shoe 24, and thus of the cutting tool 25 and the location of the lateral holes 16*a* that it forms, is determined by an indexer device 26. The assembly is locked in place by anchor 28 while the holes are formed.

Further details of the assembly shown in FIG. 1 are described in co-pending U.S. patent application Ser. Nos. 11/688,258 filed Mar. 20, 2007 and 11/585,701 filed Oct. 23, 2006, with common inventors (Brunet and Bouchard), the entirety of which disclosures are incorporated herein by reference. It will be understood by those skilled in the art, however, that other methods and devices for deflecting a cutting tool to form a lateral opening in the wellbore casing, and for subsequently deflecting or redirecting a flexible jetting hose through the lateral opening to jet a lateral borehole, are known in the art and are capable of being used with the present invention that will now be described.

Figure 2:
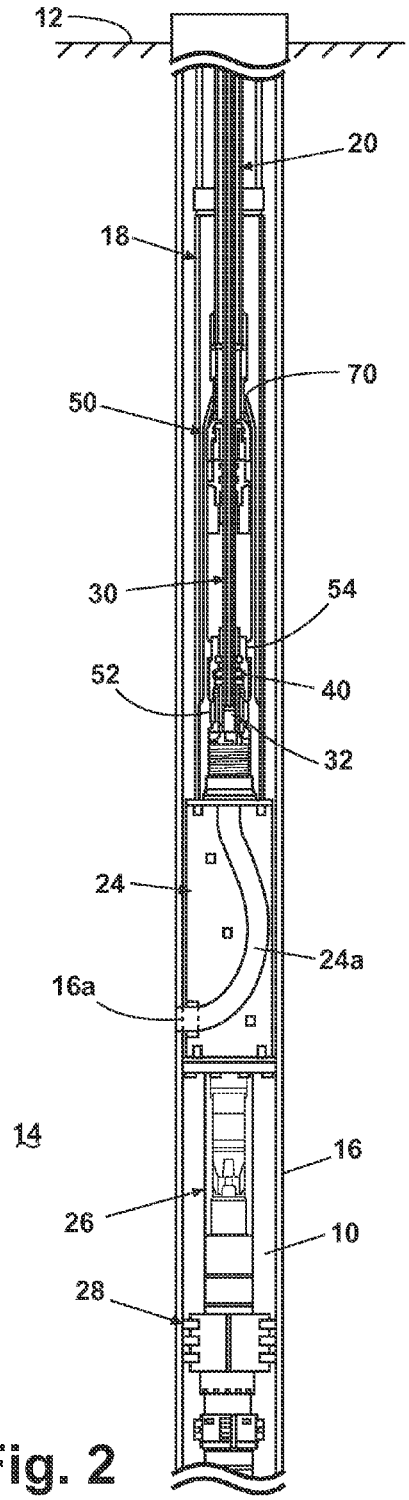
FIG. 2 is a side view of a preferred embodiment of the invention, in which the flexible jetting hose, restrained by a hose lock and seal device (HLSD) on the end of the tubing string, is landed in a landing profile on the deflector shoe.

FIG. 2 illustrates the deflector and indexer assemblies 24, 26 still anchored in place in the wellbore 10 after one or more holes 16*a* have been formed in casing 16, and after the mud motor and cutting assembly from FIG. 1 have been withdrawn from the wellbore with a known type of injector head and tubing string unit (not shown) located on the surface 12. Tubing string 20 is now used to lower a jetting hose 30 down the wellbore to be extended through the deflector 24 through channel 24*a* and out one of the holes 16*a* to jet a lateral borehole into formation 14.

In its basic form (see FIG. 12A), standard tubing string 20 is a string of "endless pipe" which is commercially available in standard sizes from ½" to 2⅞" (inches) in diameter or more. The currently preferred size of tubing string used with the present invention is in the range from 1" to 1½" in diameter. The tubing string has a high burst rating, generally in excess of 10,000 psi. The tubing string is raised and lowered in the wellbore 10 using a standard tubing string unit, the tubing being wrapped onto and off a reel at the surface and being straightened as it goes through an injector head as it is forced into the wellbore. The tubing string is typically made from various grades of steel; however, other materials such as titanium or composites can be used to construct the tubing.

Alternatively, small diameter jointed tubing 120 (FIG. 12B) of known type can be substituted for standard tubing string 20. The jointed tubing joints or sections 120*a* can be in the range from 1" to 2½" in diameter or bigger with threaded connections on each end. The sections 120*a* are assembled on the surface in known manner as the tubing 120 is lowered into the wellbore. After the complete string of joints is threaded together, standard tubing string is attached to the upper end of the tubing 120 in known manner. The jointed pipe is generally made of steel or other ferrous metal. Generally, pipe capable of operating at high pressures of 5000 psi or more is used. The jointed pipe can be coated or uncoated. The pipe can contain threads on each end for attachment to the tubing string and deflector shoe, or a flange or other type of connection can be used. Although tubing joints 120*a* are usually connected with the illustrated threaded connections, alternative quick-connect fittings can be fastened to the ends of the pipe joints to reduce the time required to fasten the pipe joints together.

Figure 8A:
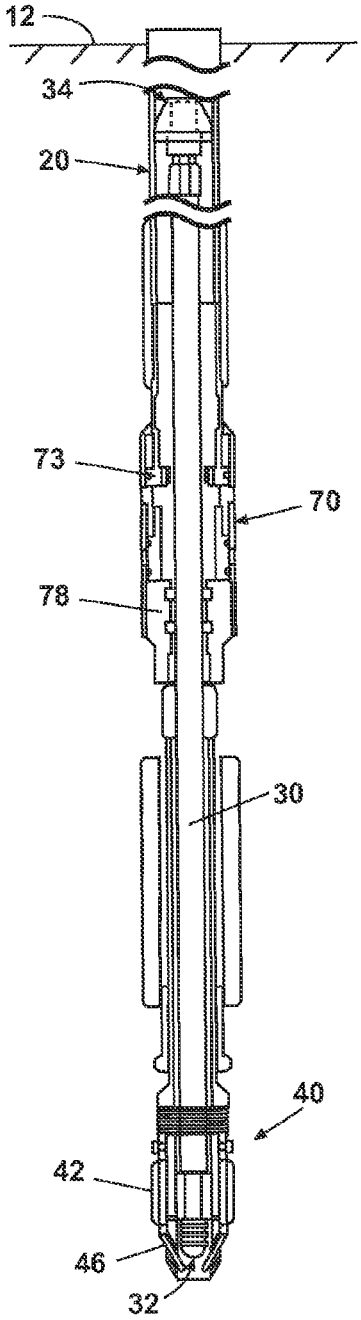
FIG. 8A is a detailed side view of the HLSD, speed control device, and jetting hose assembly in a "running position" used to convey the jetting hose downhole.
Figure 8B:
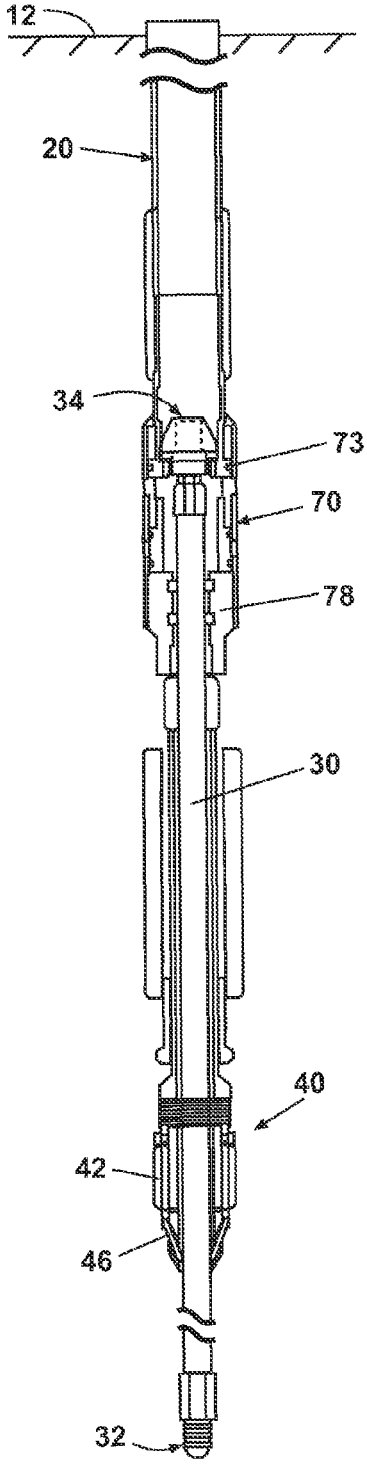
FIG. 8B is a detailed side view of the assembly in FIG. 8A in the jetting position, with the HLSD shifted to release the jetting hose assembly.

Referring to FIGS. 2, 8A-8B, and 9, jetting hose 30 is slidingly mounted within the hollow bore of tubing string 20. In the illustrated example, tubing string 20 is "standard coiled tubing" with a diameter on the order of 1¼ to 1½ inches. Jetting hose 30 is mounted on a traveling piston assembly 34 (FIGS. 8A, 8B, and 9) having an outside diameter slightly less than the inside diameter of tubing string 20 so that the piston 34 can easily slide within the tubing string. FIGS. 2 and 8A show jetting hose 30 in its "running" position in which it is conveyed to the bottom of the workstring by tubing string 20, with jetting head 32 secured in a hose lock and seal device (HLSD) 40 at the lower end of tubing 20, and with piston 34 resting further up inside the tubing at the upper end of the hose. While the length of the jetting hose 30 will vary for different drilling operations as known in the art, the hose is typically on the order of hundreds of feet long. Accordingly, the length of jetting hose 30 is often shown foreshortened in the drawings in order to illustrate piston 34 in the same Figure.

The tubing string 20 may be coated on its outer surface with a material, such as epoxy, or plastic, which would act as an insulator and transmit electrical signals along the inner surface of the tubing string. A slip-ring device located on the piston 34 can be used to maintain an electrical connection between the jetting head 32 and the interior surface of the tubing string.

A conventional wireline can also be inserted into the standard tubing string 20. This insertion is usually accomplished by lowering the tubing string into a wellbore, then lowering the wireline through the tubing string. Alternately, the wireline may be pumped down through the tubing string.

Flexible jetting hose 30, generally in a size of ½" to ¾" in diameter, is mounted inside the leading end of the tubing string 20. Jetting hose can be reeled onto and off of a reel many times during its useful life. The jetting hose also has sufficient structural strength to support it within the well bore so that it can be lowered into and pulled from a wellbore as required. The jetting hose is capable of operating at a high fluid pressure, often 5,000 psi or more. Jetting hose 30 can be manufactured in different sizes larger than the standard small diameter size of ½"-¾" generally used in the illustrated embodiment. Illustrated jetting hose 30 is flexible enough to be bent to turn through a 90-degree curve in a 2½" diameter, and has a pressure rating from 3,000 psi up to 10,000 psi. Jetting hose 30 is typically constructed of steel or Kevlar reinforced elastomer.

Figure 9:
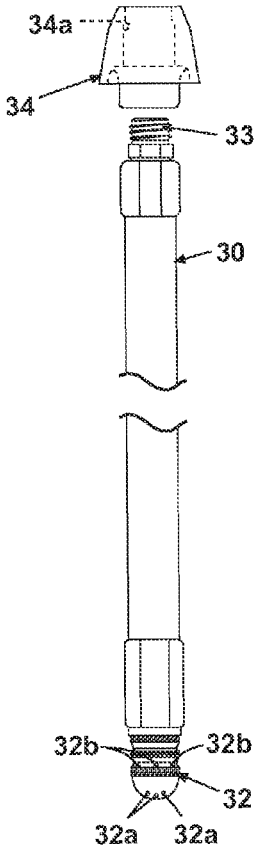
FIG. 9 is a detailed side view of the jetting hose, jetting head, and sliding piston assembly.

The jetting hose assembly is shown in more detail in FIG. 9. It includes hose 30 attached to piston 34 at the upper end of the hose, and a jetting nozzle or head 32 on the lower end of the hose. Piston 34 can be provided with external sliding seals of known type (not shown) to prevent any fluid bypass between the outside of the piston and tubing string 20, or the piston can be sized to pass a known, controlled amount of fluid pumped from the surface through tubing 20 to bypass the piston.

Piston 34 generally has the form of a movable cylinder, with threads (not shown) or other known means at its lower end to attach the piston to the upper end of jetting hose 30, for example, to a threaded end fitting 33. Piston 34 has an orifice or bore 34*a* extending through the piston in fluid communication with jetting hose 30, so that a portion of the jetting fluid pumped down tubing string 20 during the jetting operation passes through the piston into the hose, and a portion of the fluid impacts the upper surface(s) of the piston. The fluid pressure applied to the upper end of the piston 34 and exiting the rearward propulsion holes 32*b* on the jetting head forces the piston and hose assembly downwardly inside tubing string 20. It will be understood that "piston" is intended to include various shapes and configurations of slidable members, including but not limited to discs, sleeves, and other sliding members capable of being attached at an upper end of the jetting hose and operable to move up and down in the tubing string in response to the weight of the jetting hose and/or fluid pressure acting on its surfaces. The piston need not have the same cross-sectional shape as the tubing string, although generally it will be preferred so that there is a seal between the piston and the tubing string.

Jetting head or nozzle 32 is of a type generally known in the art, containing one or more openings 32*a* oriented in a forward direction for drilling purposes, as well as one or more openings 32*b* oriented in a reverse or rearward direction for propulsion purposes. High pressure jetting fluid pumped down the tubing string 20 from the surface accordingly enters the jetting head 32, with a portion of the fluid exiting the forward end of the jetting head via holes 32*a*, and the remaining fluid exiting the jetting head on the opposite, rear end via holes 32*b*. As illustrated in FIG. 5B, the fluid exiting the forward end impacts the formation 14, cutting a lateral borehole, i.e. drilling in the forward direction. The fluid exiting the jetting head on the rear end has the effect of forcing the jetting head in the forward direction. The openings 32*a* and 32*b* are sized to cause a certain pressure drop based on the amount of fluid per unit time exiting the cylinder, and subsequent propulsion force generated as a result.

As the jetting head 32 is propelled forward, it places a force F2 on the jetting hose 30 and on the tubing string 20 when the hose 30 is fully extended from the tubing string. This force F2 counterbalances the force F1 from the reaction of the fluid exiting the openings 32*a* on the formation to push the jetting hose 30 forward at a pace equal to the rate at which the formation is eroded in advance of the jetting head 32 as illustrated in FIG. 5B. In addition, there is a friction drag on the jetting hose from the formation and the deflector shoe 24 as the jetting hose penetrates the formation. This frictional drag can increase as the jetting hose moves into the formation due to the increase in the length of the jetting hose within the formation lateral borehole. Although not shown on the drawings, the jetting hose 30 will typically lie along the bottom of the lateral borehole 11 as the borehole is created. The jetting head 32 will continue to move forward, pulling the jetting hose 30 and/or the tubing string 20 along until the friction on the jetting head and tubing string exceeds this pulling force. The amount of force can be controlled and varied by controlling the amount of fluid pumped through the jetting head 32. By varying the number and diameter of these openings, the force at which the jetting head 32 is propelled in the forward direction can be manipulated. The high pressure fluid stream strikes the formation 14 as it moves forward, breaking down or disintegrating the formation and creating a borehole, in the illustrated example estimated at 1-2" inches in diameter. The rate at which the jetting head 32 advances through the formation can be controlled by the rate at which the jetting hose 30 and/or the tubing string 20 are allowed to feed into the well. If fluid pumping is continued as the jetting head is withdrawn from the lateral, a larger diameter borehole is created.

The jetting head 32 may have a number of configurations in terms of the number of forward openings 32*a* and rearward openings 32*b*, and in its simplest form the jetting head 32 would generally be a solid cylinder with the forward and rearward openings 32*a* and 32*b*. The jetting head can be constructed from carbon steel, stainless steel, or other ferrous metal. Additionally other hard materials such as ceramic may be used.

Referring primarily now to FIGS. 3A-3C, 4, and 4A-4B, jetting hose 30 is preferably held in the running position with jetting head 32 restrained in the HLSD 40 until HLSD 40 enters receiver sub 50 and lands in landing profile 52 at the bottom of the workstring, adjacent the upper end of deflector 24. HLSD 40 has two purposes: 1) to prevent the jetting hose 30 from extending out of the tubing string 20 prematurely as it is being transported to downhole target elevation and 2) to create a seal between the tubing string 20 and workstring tubing 18 at landing profile 52. If desirable, a seal can also be provided between the jetting hose 30 and the tubing string internally in the HLSD, as shown, for example, at 78. The HLSD 40 is locked at the surface 12 to secure jetting head 32, and the lock is released when weight is applied as it hits the landing profile 52 in the receiver sub 50. Once the HLSD 40 is unlocked to release the jetting head 32, the jetting head and hose 30 are free to move through the HLSD into the deflector 24 and out through the lateral opening 16*a* in the wellbore casing 16 to jet a lateral borehole.

Figure 4:
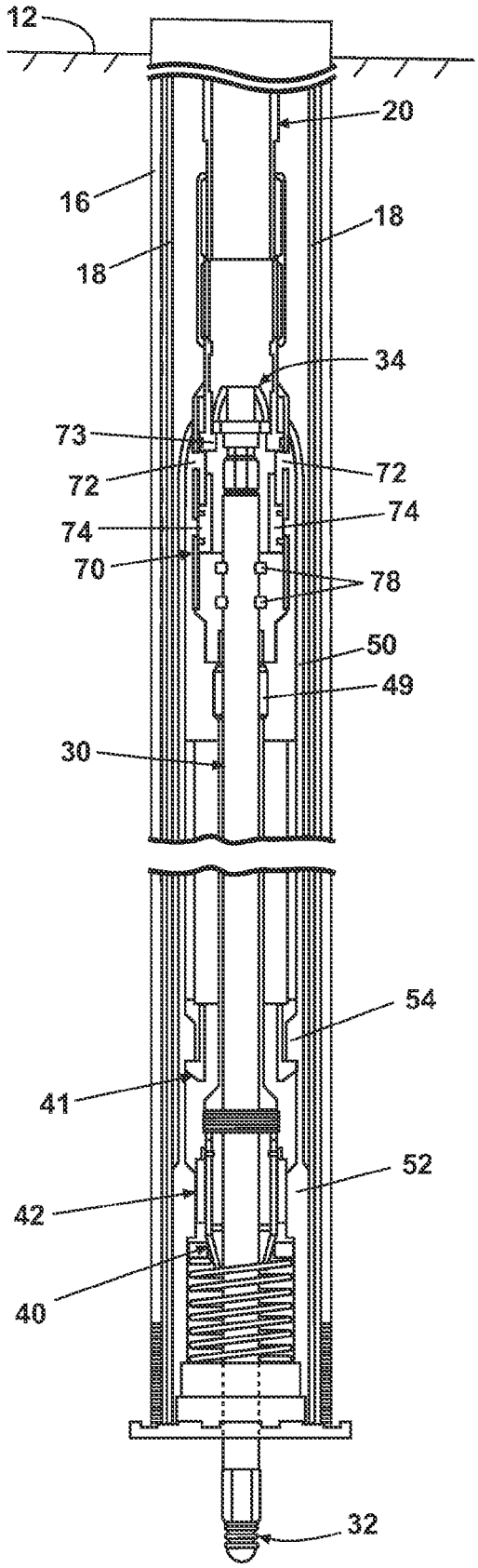
FIG. 4 is a detailed side view of the HLSD landed as in FIG. 3C, but with the jetting hose foreshortened and in its fully extended position to show the piston on the jetting hose landed in its landing profile at the bottom of the tubing string.
Figure 4A:
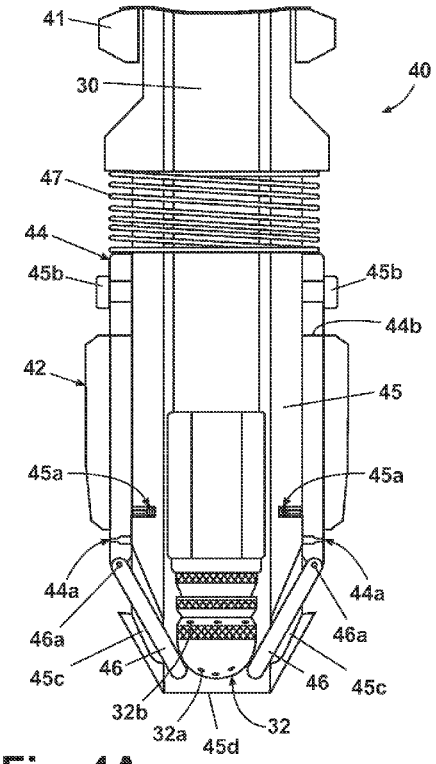
FIGS. 4A and 4B are detailed side views of the HLSD, respectively showing the jetting hose in hose-locked and hose-unlocked positions.

The HLSD 40 has two basic positions: hose released and hose locked. In the illustrated embodiment, and referring especially to FIGS. 4A and 4B, HLSD 40 is a mechanical device with an outer body 44 and an inner body 45 that are axially displaced with respect to each other to move a locking device 46 that between a locked position (FIG. 4A) that secures the jetting head 32 and prevents it from extending out the lower end opening 45*d* of the HLSD and an unlocked position (FIG. 4B) to open the locking device for passage of the jetting head 32 from the lower end of HLSD. In the illustrated embodiment, the locking device 46 is a hose restrictor in the form of pivoting fingers or hinged conical sections 46 connected to the lower end of outer body 44. Restrictor 46 is normally biased to an inwardly-angled locked position by one or more angled channels 45*c* formed in the conical lower end of inner body 45, restricting the end opening 45*d* through which jetting head 32 and hose 30 must pass for a jetting operation. The relative motion of the HLSD inner and outer body portions 44, 45 to set restrictor 46 can be accomplished manually, or in the illustrated embodiment the two body portions can be normally biased in the locked position by a compression spring 47 as shown in FIG. 4A.

The HLSD is illustrated as securing hose 30 against downhole movement in the locked position, since the fluid pressure in tubing string 20 acting on piston 34 on the upper end of the hose will tend to secure the hose against uphole movement. The fluid pressure in the tubing string is relatively low when the locking devise 46 is in a locked position. Thus, any leaking of fluid out the openings in the nozzle is negligible at this time. Any water lost during this operation will be pumped back into the tubing string 18. Alternatively, a locking mechanism (not shown) can be provided to mechanically lock the hose against uphole movement.

Figures 3A, 3B, 3C:
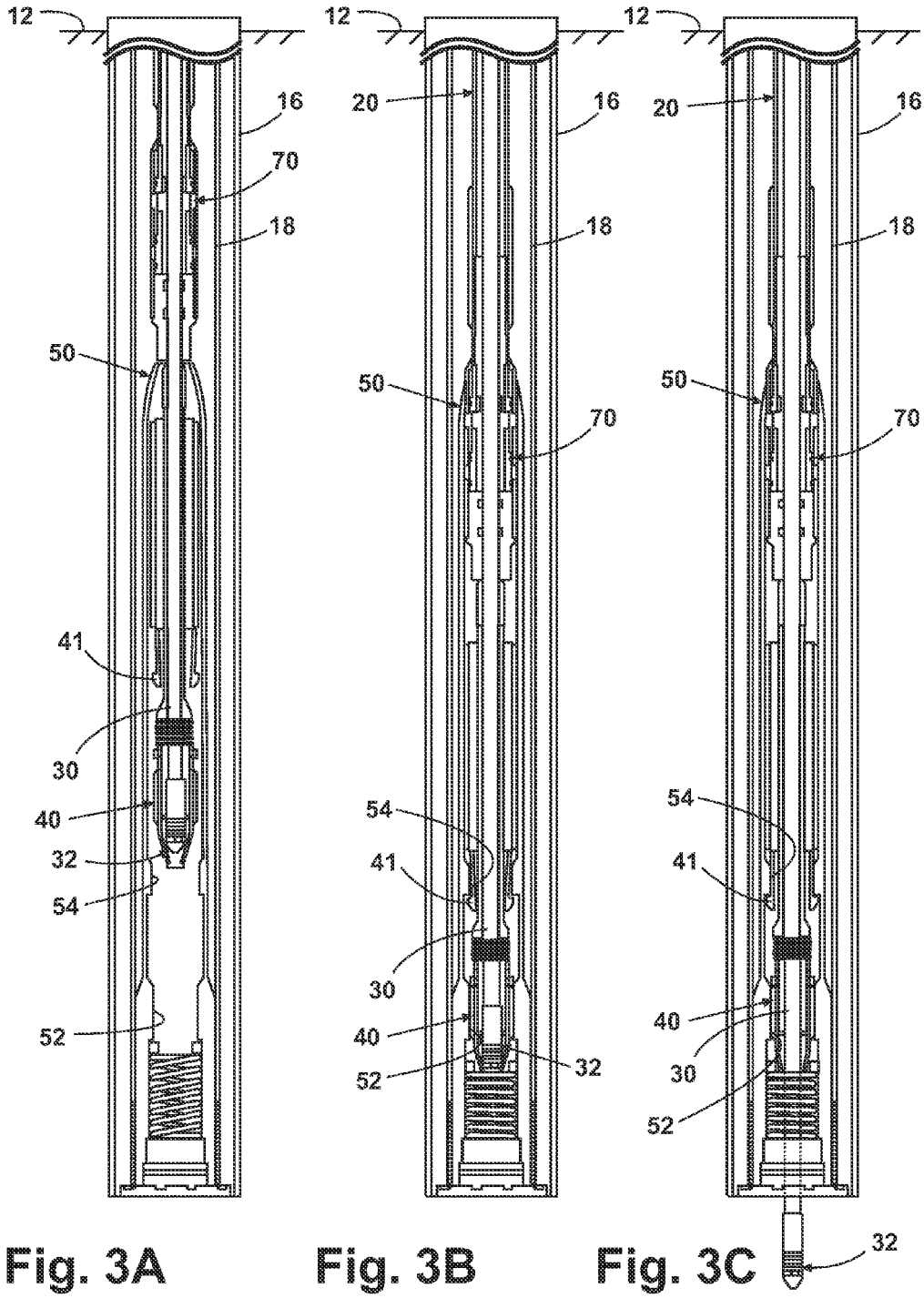
FIGS. 3A, 3B, and 3C are side views of the jetting hose and HLSD of FIG. 2 before, during, and after landing at the deflector shoe, respectively, with the hose released and being extended in FIG. 3C.

When HLSD 40 lands in landing profile 52 (FIGS. 3B and 4), seal 42 on the outer body 44 engages the profile 52 and stops, and the momentum of inner body 45 (driven by the weight of tubing string 20) drives it further for a short distance, compressing spring 47 and forcing restrictors 46 apart. Jetting head 32 and hose 30 are now released, and can be extended out from the HLSD under the fluid pressure being pumped down tubing string 20 (FIG. 3C). At the same time, bolts 45*b*, which are threaded into inner body 45, engage shoulder 44*b* to provide a positive stop against over-travel of the inner body 45 relative to the outer body 44, and a collet 41 formed around an upper part of the HLSD inner body 45 lands on and is cammed past a collet landing profile 54 on receiver sub 50 (FIGS. 3A-3C) to lock the HLSD against uphole movement for the jetting operation (FIGS. 3C and 4).

Figure 4B:
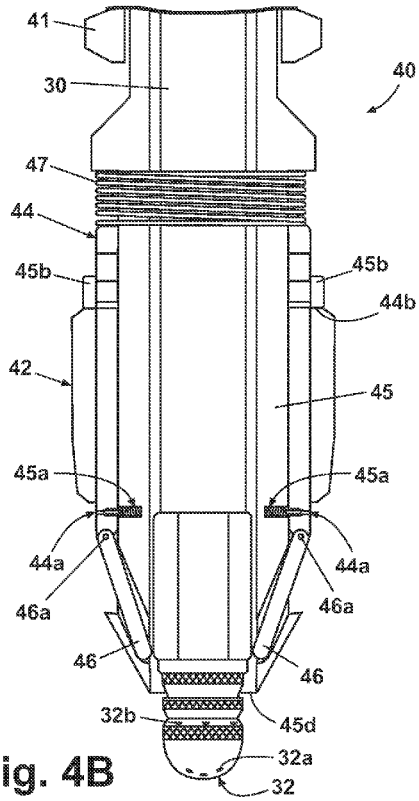

Optional means can be provided on the HLSD 40 to further secure the HLSD outer and inner bodies 44 and 45 in the hose-releasing position, especially where it is desired to release the jetting hose 30 from the HLSD while the HLSD is above deflector 24 (the "pump and lock" variation mentioned earlier, and described in more detail below with respect to FIGS. 10 and 11). FIGS. 4A and 4B show one example of such internal HLSD locking means, in which one or more spring-loaded detents or pins 45*a* on inner body 45 engage mating recesses 44*a* formed in outer body 44.

HLSD 40 can be constructed from carbon steel, stainless steel or other ferrous metal. While the mechanical restrictor arrangement 46 is currently preferred for locking the jetting head 32 in place while it is conveyed downhole, other means of locking the jetting head in place while it is conveyed downhole can be employed. For example, a simple shear system can be utilized in the HLSD device, where the weight and momentum of the tubing string when the HLSD hits the landing profile can be used to shear a pin and release the jetting head. Another alternative is to use a pressure-released lock relying on fluid pressure to unlock the HLSD and release the jetting head.

HLSD seal 42 uses a standard type of seal, usually of the O-ring type or of the Teflon-ring type, generally made from an elastomer or plastic, although other types of seal and materials can be used, including but not limited to mechanical (metal to metal) seals to packer type seals activated by setting weight down on the seal. Seal 42 not only stops the HLSD at the landing profile, but also prevents fluid under pressure in the inside of the workstring tubing 18 from exiting the annulus between the workstring and the tubing string 20.

The HLSD 40 can be threadably attached to the tubing string 20 (or other devices on the end of the tubing string), or with a collar, or using other means that will be apparent to those skilled in the art. Referring to FIG. 4, in the illustrated embodiment the upper end of HLSD 40 above collet structure 41 is connected at 49 to a speed control device 70 with annular fluid orifices 72 and check valves 74. Annular seals 78 form a sliding sealed fit with the jetting hose 30 to seal the orifices and valves in speed control device 70 from HLSD 40.

While HLSD 40 is the currently preferred device for securing the retracted jetting hose 30 in tubing string 20 as it is being conveyed by the tubing downhole, it will be understood that alternate mechanisms or devices for securing the jetting hose in the tubing string could be used. For example, a small restriction can be formed or placed higher up in the tubing string 20 to hold piston 34 in its uppermost, retracted position in the tubing, and once the tubing string has been landed at deflector 24, fluid pressure can be used to overcome the engagement between the small restriction and the piston to release the jetting hose for a jetting operation.

Referring to FIG. 5A, the speed control device 70 balances the forces above and below the piston 34 so that the speed at which the lateral bore hole is created is controlled by forces F1 and F2 in the borehole as illustrated in FIG. 5B. The speed control device controls the rate at which fluid in the annulus 31 between the outside of the jetting hose 30 and the inside of the tubing string 20 can exit the tubing string 18, which, in turn, balances the thrust and retraction forces on the piston so that the tubing weight is essentially neutral and the force of the fluid on the upper end of the piston is neutralized by the force on the lower end of the piston. Different size orifices 72 can be used in the speed control device 70 to balance the forces on the piston 34 for different fluid pressures. Thus, the control comes from an offsetting pressure under the piston to cancel out the forward push onto said piston and attached hose. By cancelling this downward force, the piston/hose/nozzle forward motion is then entirely dependent on the penetration rate of the jetting process which itself depends upon the traction created by the force of the rearward jets from the openings 32*b* against the borehole as illustrated in FIG. 5B. This speed control can also take into consideration the frictional drag on the jetting hose 30 as it penetrates the formation by slightly increasing the pressure on the upper side of the piston 34. Check valves 74 (FIG. 6A) can be located in the speed control device 70 to control the rate at which the jetting hose 30 is retracted into the tubing string, described in more detail below.

In its simplest form of design, the piston 34 is adapted to pass a predetermined amount of fluid and the speed control device 70 contains an orifice 72 which controls the amount of fluid that can be discharged from the annulus 31 between the jetting hose 30 and the tubing string 20 and through the speed control orifice 72 into the annulus 19. This orifice 72 can be selected to whatever size is required to set the desired volume of fluid exiting the tubing string 20 at a specific pressure drop. The speed control device 70 can also contain one or more check or "one-way" valves such as 74 which permit fluid to flow from the annulus 19 into the annulus 31 to push the piston 34 upwardly as fluid is pumped through the annulus 19 between the speed control device 70 and work string tubing 18 and into the annulus 31, thereby retracting the jetting hose 30 into the tubing string 20.

The speed control device 70 can be configured with a controllable variable orifice to alter the amount of fluid flow through the speed control device alter the pressure drops through the speed control. This variable speed orifice would provide a controlled range of speeds at which the jetting hose 30 can extend. In another embodiment, the speed control device 70 can have more than one orifice which can be controlled from the surface. Thus, one, two or more orifices can be opened by mechanically manipulating the speed control device from the surface by pulling on the work string 18. Alternatively, the speed control device 70 can be hydraulically shifted to open more or less orifices by using pump pressure from the surface.

The speed control device 70 can be constructed from carbon steel, stainless steel or other ferrous metal. The speed control device 70 can be threadably connected to the tubing string 20 or other devices on the end of the tubing string. Alternatively, a collar such as that shown at 76 in FIG. 4 can be used to attach the speed control device 70 to the standard tubing string 20. The speed control device 70 can be a standalone device as illustrated, or alternatively can be incorporated into the HLSD 40.

The piston landing profile 73 is located uphole from the speed control device orifices 72, at the end of the tubing string 20. The piston landing profile 73 is sized to receive the piston 34 and subsequently seal fluid from exiting the tubing string 20 around the outside of the piston 34. The piston 34 can be configured to either land, or land and lock, into the piston landing profile 73. In the simplest embodiment, piston 34 lands in the landing profile 73 and is held there by pump pressure from the surface traveling through the piston to the jetting head 32. In a second embodiment, the piston 34 is locked into place when it enters the landing profile 73 and is held there throughout the jetting process. In this locking embodiment, the piston 34 can be mechanically unlocked or alternatively hydraulically unlocked by the application of pump pressure from the surface applied in the annulus between the tubing string 20 and the workstring (and the same pressure utilized to return the piston 34 back to the starting point).

Landing profile 73 can be a separate sub or can be incorporated into the speed control device 70 or the HLSD 40. In the illustrated embodiment, speed control device 70 includes piston landing profile 73. The piston landing profile 73 can be constructed from carbon steel, stainless steel or other ferrous metal. The piston landing profile can be threadably connected to the tubing string 20 or other devices on the end of the tubing string, such as the speed control device 70 as illustrated. Alternatively, a collar can be used to attach the landing profile 73 to the tubing string 20 and other devices on the end of the tubing string.

HLSD 40 and speed control device 70 are received at the bottom of the work string by receiver sub 50. The receiver sub 50 is located on the upper end of the deflector shoe 24. HLSD 40 lands in the receiver sub 50; the weight of the tubing string 20 is then set down on HLSD 40 to release the jetting hose 30 as described above. The receiver sub 50 is generally constructed from steel or other ferrous material. The receiver sub can be connected to the deflector shoe 24 by use of a flange, or a threaded connection can be used. The receiver sub 50 contains a machined profile to land the HLSD 40, and to receive the locking collet 41. The receiver sub 50 forms an immovable anchor which supports the HLSD 40 and releases the jetting hose when the weight of the tubing string bears down on the HLSD.

The hose landing profile 52 on the receiver sub 50 is machined to receive the HLSD 40 on the leading end of the tubing string 20. The restrictor end 46 on HLSD 40 lands in a machined opening in the bottom end of the receiver sub (the bore defined through hose landing profile 52 in the drawings), and the weight of tubing string 20 then shifts the restrictor device, releasing jetting hose 30.

In the illustrated embodiment, the main connections between the components are as follows: the HLSD 40 is attached threadably to the speed control device 70. The landing profile 73 is attached on its lower end to speed control device 70, and on its upper end to the standard tubing string 20. The jetting hose 30 is placed inside the leading section of standard tubing string 20. The standard tubing string 20 is attached to the jetting hose 30 by slidable piston assembly 34. The receiver sub 50 is attached by a flange to the upper end of the deflector shoe 24. The jetting head 32 is connected to the jetting hose 30 by a threaded connection. The work string tubing 18 consists of sections which are threaded on each end and are screwed together into a continuous string as illustrated in FIG. 12B, or with a coupling illustrated in FIG. 6D.

The HLSD 40, speed control device 70, and landing profile 73 can be incorporated into a single device connected on its upper end to the standard tubing string 20, rather than formed separately and attached as illustrated.

Figure 5:
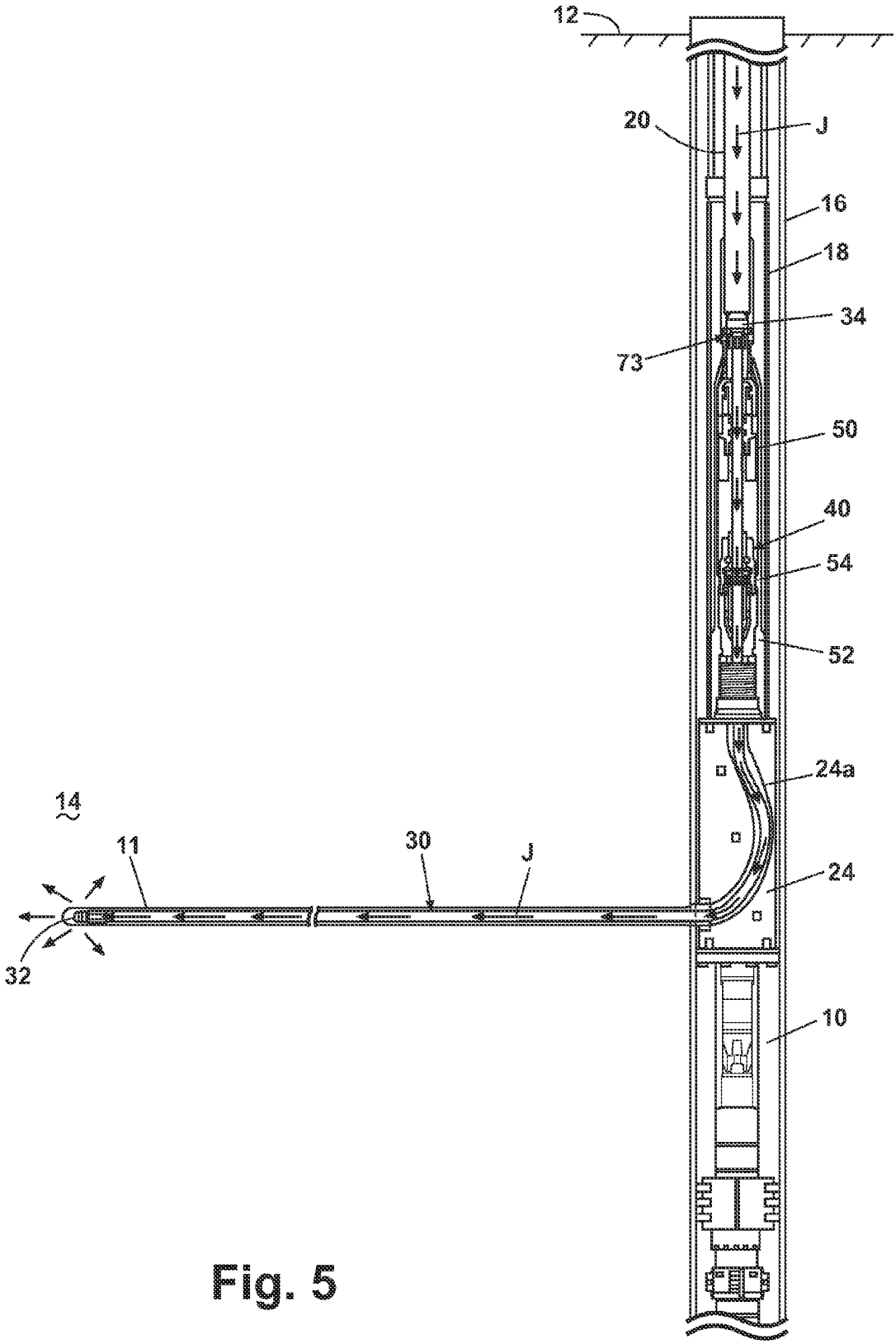
FIG. 5 is a side view of the jetting hose being pumped out of the tubing string as the lateral borehole is drilled.
Figures 5A, 5B:
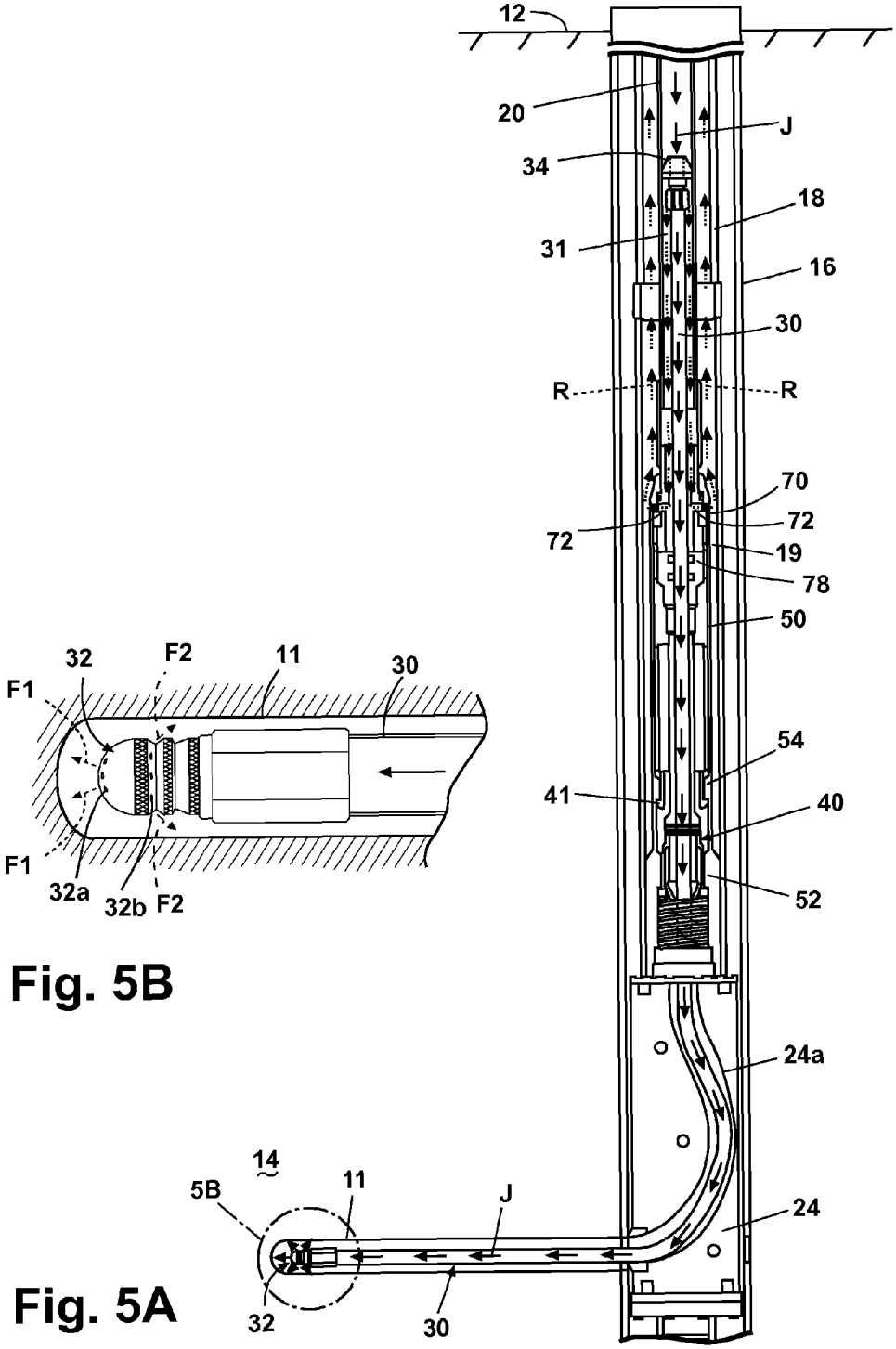
FIG. 5A is similar to FIG. 5, but further shows the feed rate of the jetting hose being controlled with a controlled release of fluid from the annulus between the tubing string and the jetting hose as the hose advances.
FIG. 5B is an enlarged partial view of the nozzle end of the jetting hose in a formation in the area 5B of FIG. 5A and illustrating the forces on the jetting nozzle during the jetting operation.

FIG. 5 illustrates the jetting hose 30 being pumped out through the landed HLSD 40 with jetting fluid J to jet a lateral borehole 11. FIG. 5A illustrates fluid flow through speed control device 70 as the lateral borehole 11 is being jetted by jetting fluid J pumped through tubing string 20. The pumped jetting fluid J enters jetting hose 30 through piston 34 and is forced through the nozzle which has the dual functions of 1) jetting away the formation material 14 with its forward pointing jets (drilling) (through openings 32*a*), and 2) forcing the jetting hose forward with its backward facing jets (through openings 32*b*). As the piston 34 moves down the tubing string 20 it forces out the fluid R in the annulus 31 between the jetting hose 30 and the inside wall of the tubing string 20. The fluid R is expelled in the production (work string) tubing 18 through orifices 72 below the piston landing profile 73 and above the Teflon seals 78.

The ideal is to have the jetting operation completely nozzle-driven, i.e. the penetration speed of the jetting head 32 in formation 14 is self-regulated (no pushing or restraining of the jetting hose 30 from the surface via the tubing string 20). For this self-regulation to happen, it is important that the pressure pushing on top of the piston is counterbalanced by the pressure under the piston (i.e. the exiting fluid J). There are two ways this can be accomplished.

First, the speed control exit orifices 72 can be sized to limit the flow therethrough to a predetermined maximum rate which will be different for different formations. This limitation would ensure that a maximum penetration rate for the hose 30 couldn't be exceeded, therefore ensuring that no excessive force is acting to force hose 30 down. This is the method illustrated in FIG. 5A.

Second, the system can be fully compensated by ensuring that the fluid pressure force acting on the upper surface of the piston 34 is balanced by an equal force applied to the underside of the piston 34, so that the two forces mostly cancel each other out, leaving the jetting nozzle 32 to drive the jet-drilling process. The two forces can be slightly different with greater pressure on the upper surface of the piston 34 to compensate for frictional drag on the hose as it penetrates the formation as described above. This balance can be done by filling the inside of the production (work string) tubing with counterbalancing fluid R and applying the necessary counter-pressure through R in the annulus between the tubing string 20 and the production tubing 18.

Figure 6:
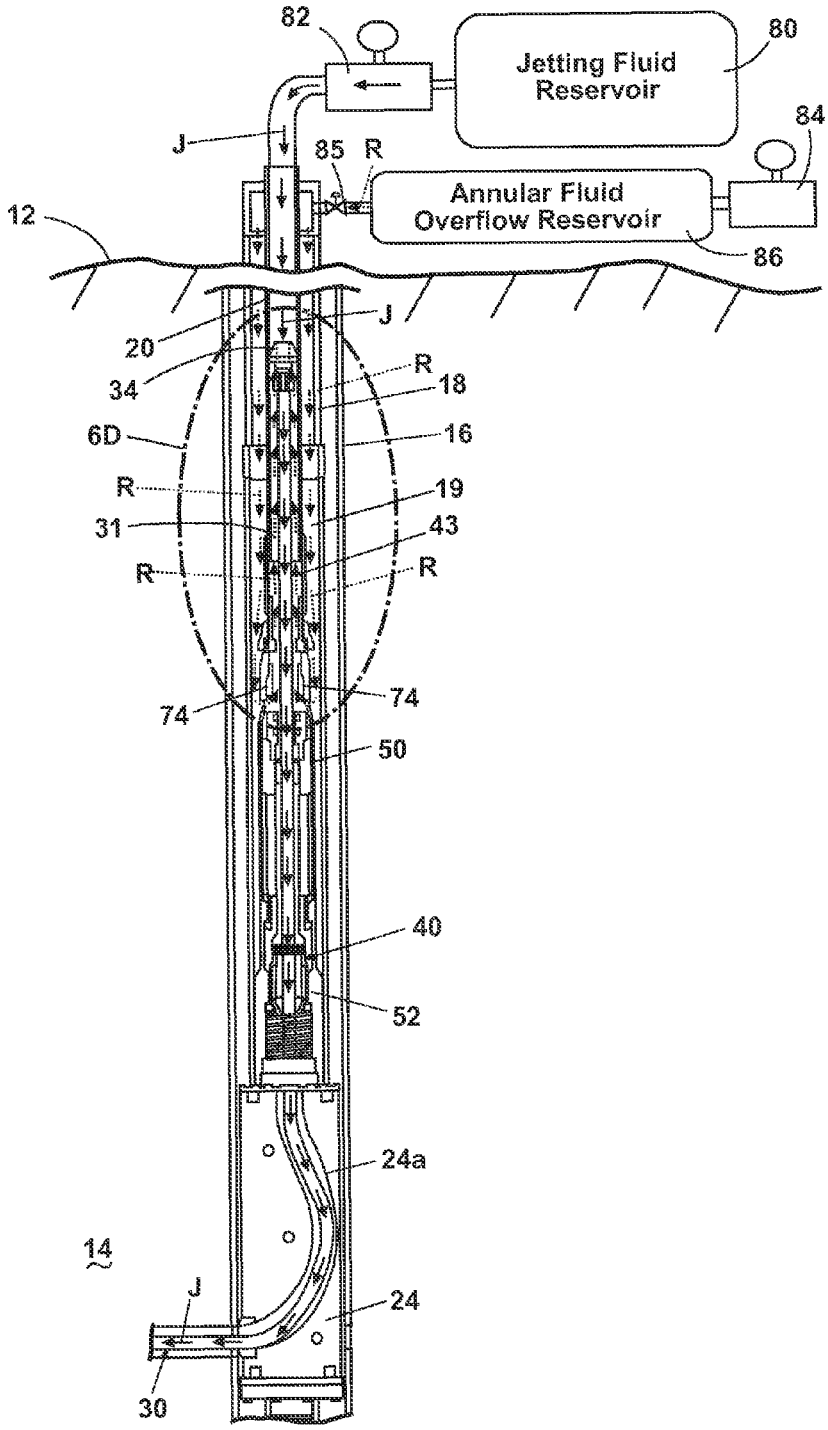
FIG. 6 schematically shows a surface pumping system for counterbalancing the jetting and annular fluid pressures acting on the piston to control the penetration rate of the jetting hose.
Figure 6A:
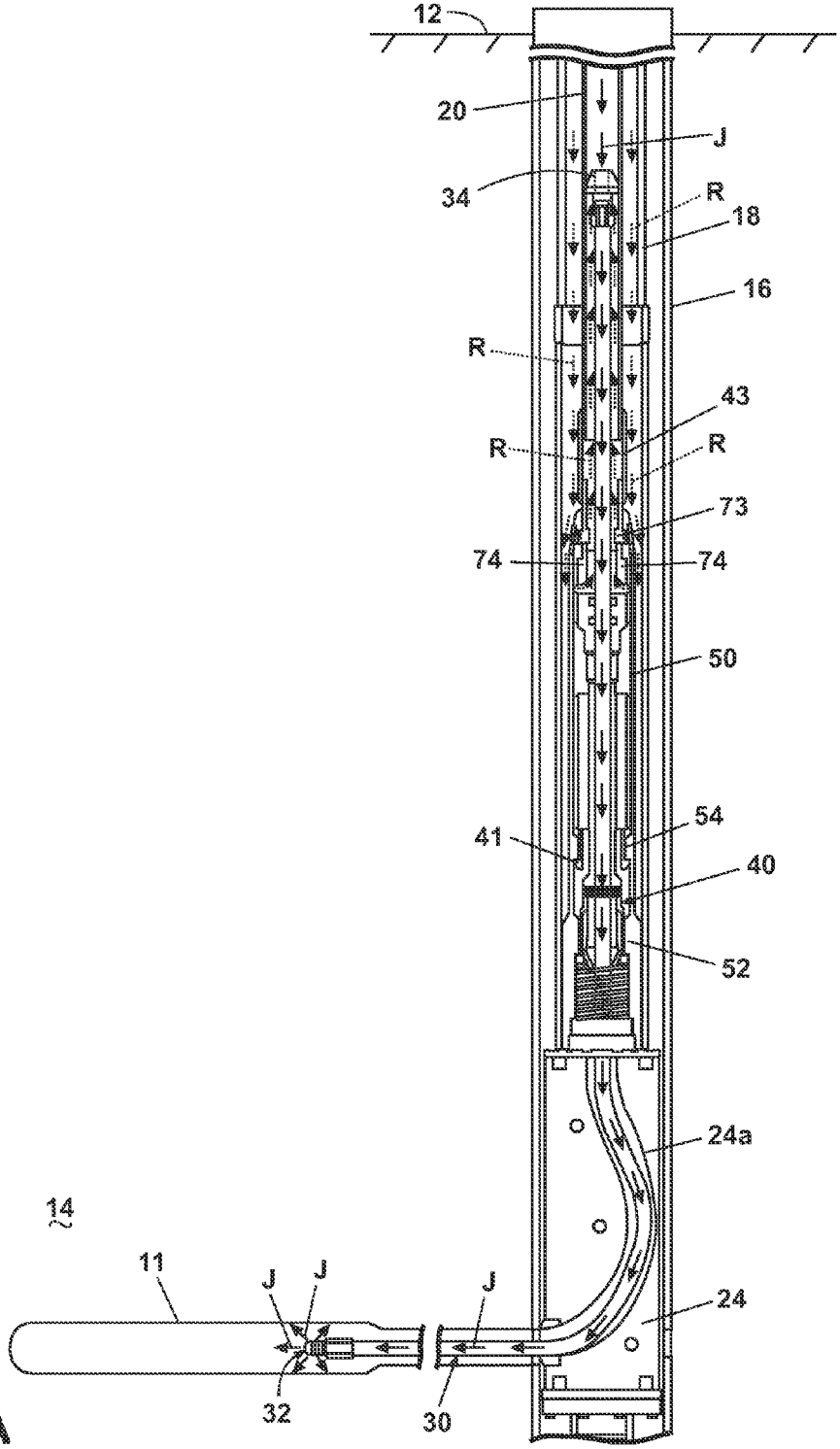
FIG. 6A illustrates the jetting head being retracted from the borehole into the main wellbore by increasing the fluid pressure in the annulus between the tubing string and the jetting hose below the piston.
Figure 6B:
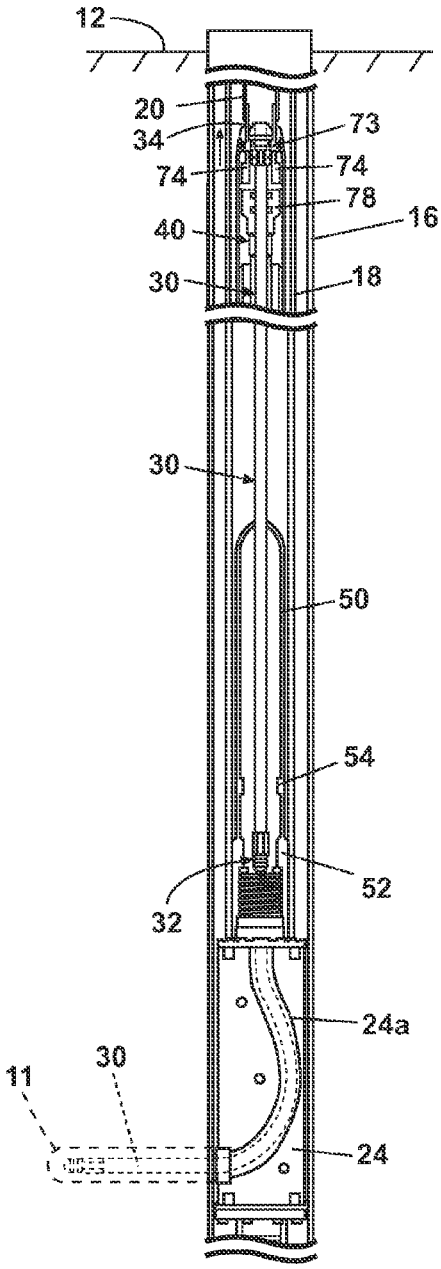
FIG. 6B illustrates the jetting hose being withdrawn from the borehole by raising the tubing string while the jetting hose is fully extended.
Figure 6C:
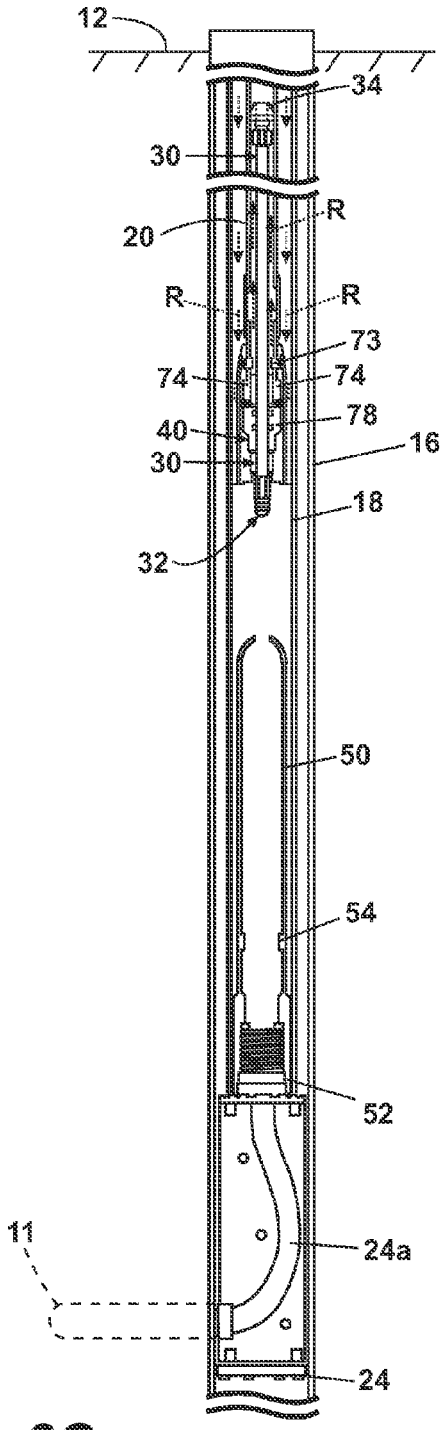
FIG. 6C illustrates the jetting hose, withdrawn into the main wellbore as in FIG. 6B, subsequently being forced back up into the tubing string by increasing the fluid pressure in the annulus between the tubing string and the jetting hose below the piston as in FIG. 6A.
Figure 6D:
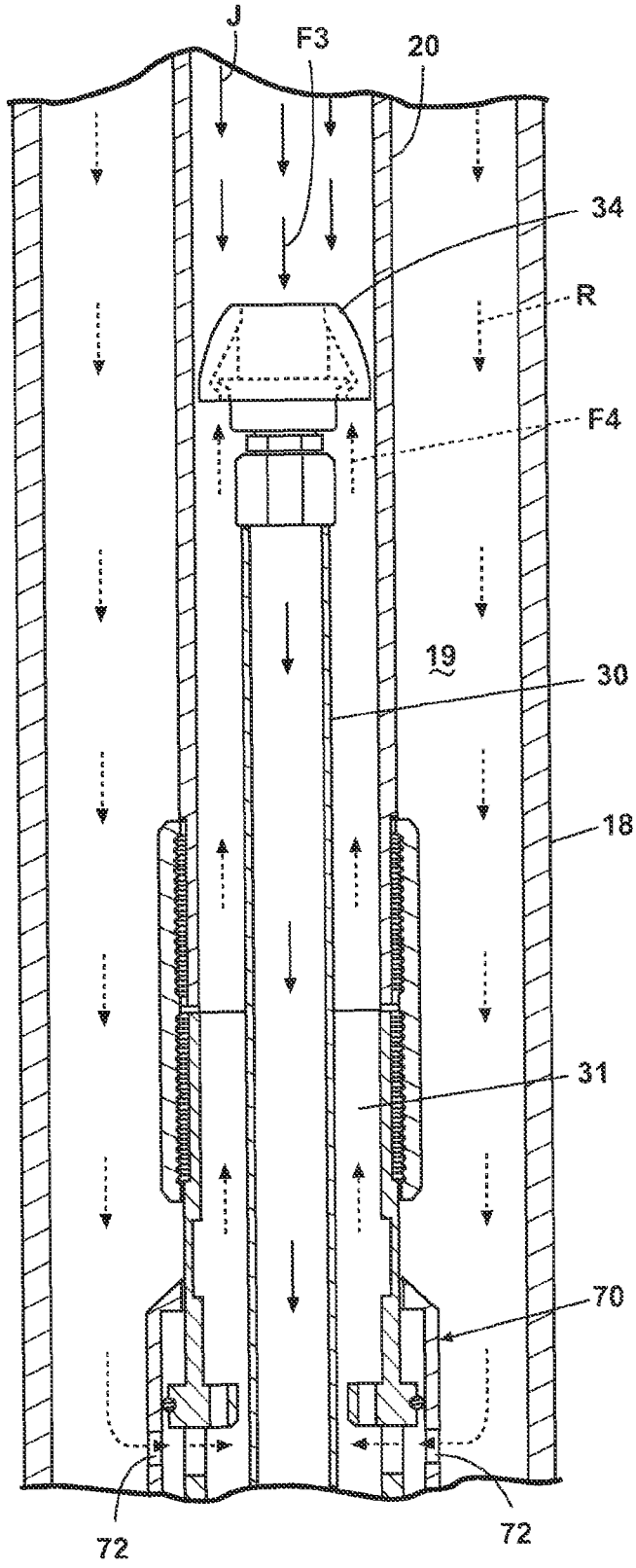
FIG. 6D is an enlarged partial view of the upper portion of the jetting hose in the area 6D of FIG. 6 and illustrating the balancing of forces on the piston during the jetting operation.

This second method is illustrated in FIGS. 6 and 6D, in which the force F3 exerted by jetting fluid J on top of piston 34 is counterbalanced by the force F4 of fluid R acting through check valves 74 against the bottom of piston 34 (FIG. 6D). FIG. 6 also schematically illustrates a preferred surface pumping arrangement for using fluid pressure R to counterbalance the jetting fluid pressure J. While fluid J is pumped down tubing string 20 by a pump 82 from a jetting fluid reservoir 80 in known fashion, a second pump 84 is used to pressurize the annular fluid R normally received or contained in overflow reservoir 86. By properly adjusting the jetting pump 82 and the annular pump 84, the jetting nozzle 32 can be fully compensated to let the nozzle itself regulate the rate at which it penetrates the formation surrounding the wellbore to form a lateral borehole. Also, by observing the fluid level in the annular fluid reservoir 86, the operator can estimate the length of the lateral borehole. The amount of fluid inside the annulus between the tubing string 20 and the jetting hose 30 is a finite, known quantity. When this quantity has been displaced into the annular reservoir 86, the operator will know that the lateral borehole is completed.

An alternative method of controlling the forces F3 and F4 on the piston 34 is also illustrated in FIG. 6. In lieu of controlling the pump pressure 84, a control valve 85 with a variable orifice can be placed in the conduit between the annular fluid overflow reservoir 86 and the annulus 19. By controlling the opening of this orifice/valve 85, which is in direct fluid contact with the bottom surface of the piston via the tubing/workstring annulus 19 and hose/tubing annulus 31 through orifice 72, the force F4 can be controlled to counterbalance force F3.

This orifice 85 fulfills essentially the same function as the size of the orifice 72 in the other embodiments except it is located at surface where controlling the size of the opening with orifice valve 85 is much easier. Through the same orifice/valve 85, the fluid from the reservoir 86 can be pumped back into the annulus 19 using pump 84 to retract the hose inside tubing 20. Alternately, a check valve like 74 can be used for this purpose.

In this embodiment, the orifice 72 has to be big enough so that it does not restrict exiting fluids but simply provides a communication orifice between the two annuluses 31 and 19. Further, check valve 74 becomes obsolete.

FIG. 6A shows the fluid R in the annulus further being used to retract the jetting hose 30 back up inside the landed tubing string 20 by making the force of fluid pressure R acting on the bottom of piston 34 through check valves 74 greater than the force of fluid pressure J acting on the top of piston 34 through tubing string 20. By continuing to pump fluid J down the tubing string, the jetting head 32 enlarges borehole 11 as it is retracted back up into HLSD 40.

FIG. 6B shows an alternate method of pulling jetting hose 30 out of the completed lateral borehole 11, in which the tubing string 20 is raised back up the main wellbore while the jetting hose 30 is fully extended from the tubing string, with piston 34 landed and held in its landing profile 73. This method is essentially the same as that used to withdraw prior art jetting hose fixedly attached to the end of the tubing string.

FIG. 6C shows a third method of pulling jetting hose out of the completed lateral borehole 11. The tubing string is first pulled back up the main wellbore as in FIG. 6B, with jetting hose 30 fully extended from the tubing string, until jetting hose 30 is withdrawn back into the main wellbore. Then fluid R is pumped downhole through the annulus to act against the lower end of piston 34 to retract jetting hose 30 back up inside tubing string 20 as described above in FIG. 6A. This method is believed to be easier to control than the method in FIG. 6A, and is an inherent option in the structure illustrated in FIGS. 2 through 6A.

FIG. 7 shows the completed lateral borehole 11 formed during the steps in FIGS. 5 through 6A, and the fully retracted hose 30 in HLSD 40 being withdrawn back up the wellbore by the tubing string unit at the surface. The frictional engagement between collet 41 and collet landing profile 54 is designed to be overcome by the pull of a typical tubing string unit pulling on tubing string 20. When HLSD 40 is pulled out of its landing profile 52, its upper spring 47 (FIGS. 4A and 4B) will push main (outer) body 44 downward (along with any internal locking structure in the HLSD such as the spring-loaded pins 45*a* shown in FIGS. 4A and 4B), resulting in hose restrictor arms 46 sliding down to be cammed inwardly by inner body 45 to secure jetting head 32 and hose 30 in the retracted position.

If more than one lateral borehole is being jetted at a given depth, it may be desirable to operate an indexer or other deflector-reorienting device such as 26, for example, by limited reciprocation of the tubing string 20, and then to repeat the jetting process described in FIGS. 5 through 6A until the desired number of lateral boreholes is jetted. When the last lateral borehole is done at this depth, the tubing string 20 with the hose 30 retracted inside HLSD 40 can be pulled back up to the surface.

Figure 10:
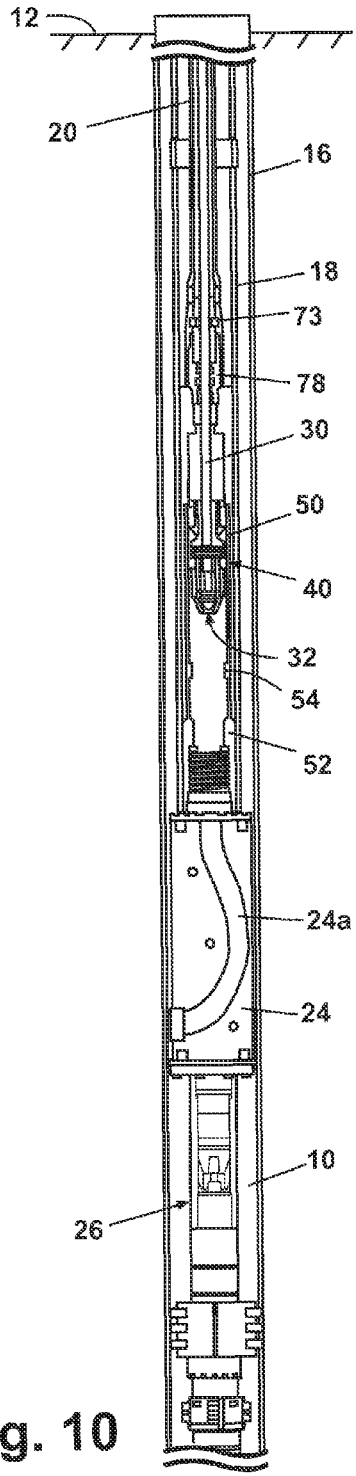
FIG. 10 is a side view of the HLSD-secured jetting hose prior to landing in the hose landing profile, in the running position.
Figure 11:
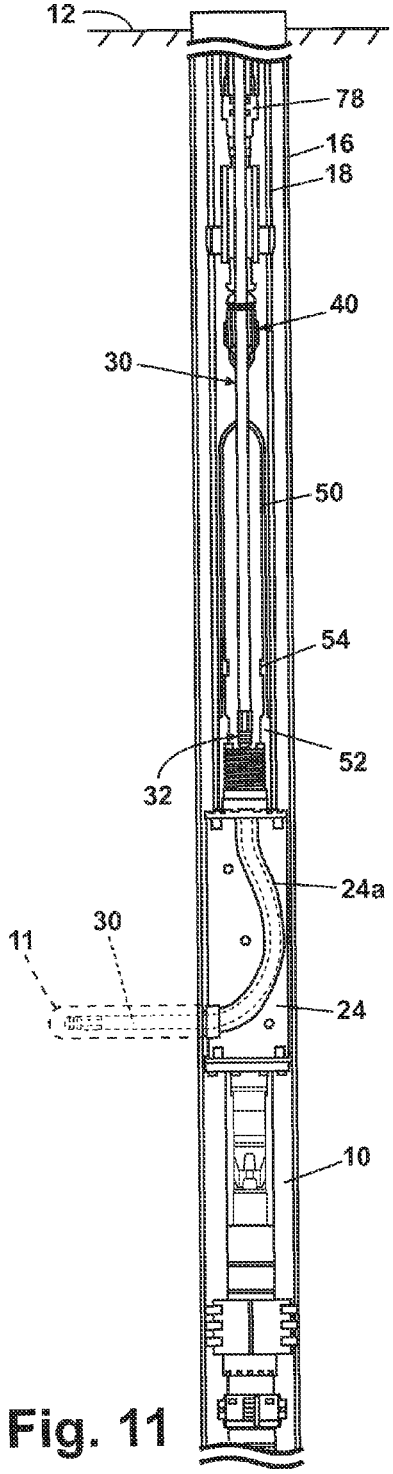
FIG. 11 shows the jetting hose being extended out of the tubing string by pump pressure as the tubing string is lifted, either before the HLSD has been landed in the hose landing profile, or after the HLSD has "tagged" the hose landing profile and the tubing string is being lifted back up, to fully extend the hose prior to jetting a lateral.

FIG. 10 is a side view of the HLSD-secured jetting hose 30 stopped above deflector 24 and landing profile 52 at the bottom of the workstring while the HLSD is unlocked to release the jetting hose. The HLSD 40 is unlocked either by abruptly halting the tubing string 20 before the HLSD 40 reaches the deflector 24 or, alternately, by lowering the HLSD to briefly contacts or "tag" the landing profile 52 at the deflector 24 and then reeling it back up to a point above the deflector. The momentum of the abrupt stop or the force of the temporary contact with the landing profile triggers the HLSD 40 to release the jetting hose 30 as described above. FIG. 11 shows jetting hose 30 then fully extended (solid lines) from the tubing string 20 prior to entering deflector 24, again as described above by pumping pressurized fluid down the tubing string against the piston 34 until the piston lands and is held or locked in the piston landing profile 73 at the end of the tubing string. The tubing string 20 is then lowered with the jetting hose 30 fully extended from the end of the tubing 20 to initiate the jetting operation as shown in broken lines in FIG. 11.

It will finally be understood that the disclosed embodiments are representative of presently preferred forms of the invention, but are intended to be illustrative rather than definitive of the invention. Reasonable variation and modification are possible within the scope of the foregoing disclosure and drawings without departing from the spirit of the invention.

What is claimed:

1. An apparatus for jetting lateral boreholes from a main wellbore using a high pressure jetting hose conveyed down a workstring in the wellbore by a tubing string, the apparatus comprising:

a releasable hose locking device mounted on an end portion of the tubing string to selectively retain the high pressure flexible jetting hose within the tubing string in a hose-conveying position retracted inside the tubing string and to release the jetting hose for movement to a jetting position extended from the lower end portion of the tubing string to jet a lateral borehole from the wellbore.

2. The apparatus of claim 1 and further comprising a fluid-operated piston mounted to the jetting hose and sized to slide within the tubing string.

3. The apparatus of claim 2 wherein the piston is mounted on an upper end of the jetting hose so that the jetting hose depends from the piston.

4. The apparatus of claim 3 wherein the piston includes a passage between the tubing and the jetting hose to pass jetting fluid therethrough, whereby jetting fluid pumped down the tubing string applies hose-extending fluid pressure to the piston and also passes through the piston into the jetting hose for jetting a lateral borehole through a jetting head.

5. The apparatus of claim 4 and further comprising a speed control on the tubing string to control the balance between the thrust and penetration rates of the lower end of the jetting hose.

6. The apparatus of claim 5 wherein the speed control comprises a fluid-relief orifice between the piston and the jetting head to release fluid driven by the downward movement of the piston from a first annulus between the tubing string and the jetting hose into the workstring.

7. The apparatus of claim 1 wherein the tubing string comprises coiled tubing with a diameter in excess of one inch (2.54 cm).

8. The apparatus of claim 1 wherein the tubing string comprises jointed tubing.

9. The apparatus of claim 1 wherein the releasable hose locking device is positioned at a leading end of the tubing string.

10. The apparatus of claim 1 wherein the hose locking device is at least in part responsive to the weight of the tubing string to release the jetting hose.

11. The apparatus of claim 1 and further including a landing profile positioned adjacent a location within the wellbore where a lateral borehole is to be jetted; wherein the landing profile is configured to receive and unlock the hose-locking device to release the jetting hose.

12. The apparatus of claim 11 wherein the landing profile comprises a receiver sub mounted above a hose-deflector device in the wellbore.

13. The apparatus of claim 1 wherein the hose-locking device comprises opposed fingers that are movably mounted between a locking and release position with respect to the lower end portion of the jetting hose, and the fingers are biased into the locking position.

14. A method for jetting lateral boreholes from a main wellbore using a high pressure flexible jetting hose comprising:

positioning the high pressure flexible jetting hose within a tubing string in an upper portion of the main borehole;

releasably locking a lower end portion of the high pressure flexible jetting hose to a lower end portion of the tubing string;

conveying the tubing string down the main borehole with the high pressure flexible jetting hose inside the tubing string to a predetermined depth at or near a producing strata;

unlocking the lower end of the high pressure flexible jetting hose from the lower end of the tubing string;

extending the high pressure flexible jetting hose from the lower end of the tubing string and into a jetting position to bore a lateral bore hole in the producing strata; and pumping a jetting fluid under pressure into the tubing string and into the high pressure jetting hose to jet a lateral borehole from the main wellbore.

15. The method of claim 14 wherein the unlocking act includes the act of landing the lower end of the tubing string on a landing profile at the predetermined depth of the wellbore to release the lower end of the jetting hose from the lower end of the tubing string.

16. The method of claim 14 wherein the extending act includes raising the tubing string with respect to the high pressure jetting hose to extend the lower end portion of the jetting hose from the lower end portion of the tubing string.

17. A method of claim 16 wherein the lower end portion of the tubing string is held at the landing profile in the wellbore as the jetting hose is extended from the lower end of the tubing string to jet a lateral borehole in the producing strata.

18. The method of claim 14 wherein the moving act of the lower end portion of the jetting hose with respect to the tubing string subsequent to the unlocking act is responsive to the pressure of the jetting fluid pumped through the tubing string and into the jetting hose to simultaneously jet a borehole in a formation in front of the lower end portion of the jetting hose and provide a forward thrust behind lower end portion of the jetting hose to penetrate the formation.

19. A method of claim 14 and further including substantially balancing the forces on an upper portion of the jetting hose during the moving act to so that the jetting hose moves into the formation at a controlled rate that reflects the rate at which the jetting action bores into the formation.

20. The method of claim 19, wherein the balancing act includes applying fluid pressure from a second annulus between the workstring and the tubing string into a first annulus between the jetting hose and the tubing string and to an upper portion of the jetting hose.

21. The method of claim 20 and further comprising pumping fluid down the workstring from a second annulus between the workstring and the tubing string into the first annulus between the jetting hose and the tubing string against an underside of a piston to retract the jetting hose back up into the tubing string after the lateral borehole has been jetted.

22. The method of claim 14 and, subsequent to the pumping act, retracting the high pressure flexible jetting hose into the lower end of the tubing string from the jetting position after the lateral borehole has been jetted until the jetting hose is withdrawn at least back into the wellbore.

23. The method of claim 22 and further comprising pumping fluid down the workstring to an underside of the piston after the jetting hose has been withdrawn into the wellbore to retract the jetting hose back up into the tubing string.

24. A method of jetting lateral boreholes from a main wellbore using a high pressure jetting hose, comprising the steps of:

conveying the jetting hose down a workstring in the wellbore with a tubing string;

landing the tubing string in the wellbore; and independently moving the jetting hose relative to the tubing string prior to or during a lateral jetting operation in order to position the jetting hose for a lateral jetting operation;

wherein the act of independently moving the jetting hose includes moving the jetting hose independently of the tubing string prior to landing the tubing in the wellbore.

25. The method of claim 24 wherein the act of independently moving the jetting hose includes extending the jetting hose relative to the tubing string prior to the lateral jetting operation and then further conveying the extended jetting hose downhole with the tubing string to initiate the lateral jetting operation.

26. The method of claim 24 wherein the act of independently moving the jetting hose includes extending the jetting hose relative to the tubing string after landing the tubing string in the wellbore to initiate the jetting operation.

27. The method of claim 24 wherein the act of independently moving the jetting hose includes controlling the rate at which the jetting hose penetrates a formation by balancing the thrust forces on the jetting hose during the lateral jetting operation with retraction forces on the jetting hose so that the jetting hose can penetrate the formation at substantially the same rate that it moves with respect to the tubing string.

28. The method of claim 24 wherein the act of independently moving the jetting hose includes pumping jetting fluid through the tubing string into the jetting hose.

29. A method of jetting lateral boreholes from a main wellbore using a high pressure jetting hose, comprising the steps of:

conveying the jetting hose down a workstring in the wellbore with a tubing string, and independently moving the jetting hose relative to the tubing string prior to or during a lateral jetting operation in order to position the jetting hose for a lateral jetting operation; and retracting the jetting hose relative to the tubing string after the lateral jetting operation;

wherein the act of retracting the jetting hose includes pumping fluid down the wellbore around the tubing string.

30. A method for conveying a jetting hose down a wellbore with tubing string for jetting lateral boreholes from the wellbore, comprising the steps of:

conveying the jetting hose down the wellbore inside the tubing string;

extending the jetting hose from the tubing string to jet a lateral borehole; and retracting the jetting hose back into the tubing string after the lateral borehole is jetted;

wherein the act of retracting the jetting hose back into the tubing string includes pumping fluid under pressure down the wellbore around the tubing string.

31. The method of claim 30, wherein the act of extending the jetting hose from the tubing string includes pumping jetting fluid through the tubing string into the jetting hose.

32. The method of claim 31 and further including controlling the rate at which the jetting hose is extended from the tubing string so that the jetting hose is extended at substantially the same rate that it penetrates a formation.

33. The method of claim 32 wherein the act of controlling the rate includes applying a counterbalancing fluid pressure to an upper portion of the jetting hose as the jetting hose is extended.

* * * * *